US009764912B1

(12) United States Patent
McFarland et al.

(10) Patent No.: US 9,764,912 B1
(45) Date of Patent: Sep. 19, 2017

(54) REMOVABLE MEDIA TRAY HAVING SLIDING TRAY EXTENSION OPERABLE BY A REAR MEDIA RESTRAINT

(71) Applicant: LEXMARK INTERNATIONAL, INC., Lexington, KY (US)

(72) Inventors: Neal Douglas McFarland, Versailles, KY (US); Angel Macuha Alagos, Cebu (PH); Joe Carlo Enoc Bacon, North Cotabato (PH); Dustin Daniel Fichter, Versailles, KY (US); Pat Marlon Limosnero, Cebu (PH); Katherine Mary Mulloy, Georgetown, KY (US); Edward Joseph Walden, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 15/146,141

(22) Filed: May 4, 2016

(51) Int. Cl.

| | |
|---|---|
| ***B65H 1/00*** | (2006.01) |
| ***B65H 1/26*** | (2006.01) |
| ***B65H 1/04*** | (2006.01) |
| ***B65H 1/12*** | (2006.01) |

(52) U.S. Cl.
CPC ..... *B65H 1/266* (2013.01); *B65H 1/04* (2013.01); *B65H 1/12* (2013.01); *B65H 2405/10* (2013.01); *B65H 2701/1131* (2013.01); *B65H 2701/11312* (2013.01); *B65H 2801/12* (2013.01)

(58) Field of Classification Search
CPC ..... B65H 1/266; B65H 2701/11312; B65H 2701/1131; B65H 2701/113
See application file for complete search history.

(56) References Cited

U.S. PATENT DOCUMENTS 6,149,147 A * 11/2000 Hur ..... B65H 1/12 271/147
7,607,657 B2 * 10/2009 Kawarago ..... B65H 1/266 271/171

* cited by examiner

*Primary Examiner* — Howard Sanders

(57) ABSTRACT

A removable media tray with an adjustable rear tray extension operable by a rear media restraint. The tray extension is slidably attached to a front section of the tray via a cam having a locking arm engaged in a J-slot. When in the curved portion of the J-slot the front section and tray extension are locked together. A rear media restraint slidably latching to a track in the bottom of the tray has a locking lobe that engages with a locking notch on the cam. As the media restraint is slid toward the rear, the locking lobe initially rotates the cam moving the locking arm to the straight section of the J-slot, then the locking lobe engages with the locking notch, locking the media restraint to the tray extension. Thereafter, the media restraint and tray extension move together until the end of the J-slot is reached by the locking arm.

27 Claims, 16 Drawing Sheets

REMOVABLE MEDIA TRAY HAVING SLIDING TRAY EXTENSION OPERABLE BY A REAR MEDIA RESTRAINT

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

Field of the Invention

The field relates generally to media input feed systems for an imaging device having a removable media tray with a rear tray extension.

Description of the Related Art

Imaging devices utilize removable media trays for holding stack of media to be processed by the imaging device. The removable media tray is designed to handle a variety of media lengths, such as A6, Letter, A4 and Legal media having lengths of 148 mm, 279 mm, 297 mm and 356 mm, respectively. One approach to accommodate this range of media lengths is to make the length of the removable media tray longer than the longest designed-for media length to be used in the imaging device where the walls of the removable media tray do not move and which will only support the prescribed media sizes. Another approach is to provide a tray that is extendable. Typically, the rear media restraint is mounted directly to the rear tray extension with these two parts moving independently of one another. Most media sizes (other than the shortest or longest) have multiple position combinations of the rear media restraint and the rear tray extension to equal a prescribed media length, making it challenging for the user to understand the latching mechanism and media length labeling. Usability testing has shown that having the rear media restraint and rear tray extension moving independently is very confusing for the user. This is further complicated by the media size indicators provided in the removable media tray no longer aligning when the removable media tray is extended. Lastly it can be unclear to the user how to retract the rear tray extension and rear media restraint back into their initial "home" positions.

It would be advantageous to be able to adjust the length of the removable media tray without the use of complicated latching mechanisms. It would be further advantageous to use the movement of the rear media restraint to move the tray extension when needed for the longer designed-for media lengths. It would be further advantageous to have the media restraint move independently of the tray extension when the tray extension is in its retracted position.

SUMMARY OF THE INVENTION

Disclosed is a removable media tray having a tray extension operable by a rear media restraint. The removable media tray comprises a front section, a tray extension slidably received in the front section and a rear media restraint. The front section includes a bottom having a front edge, a rear edge, a left side edge and a right side edge with the bottom having a J-slot therein. The J-slot has a curved section having a first end and a second end with the first and second ends positioned generally parallel to the rear edge of the bottom of the front section at a first predetermined distance D1 and a straight section parallel to the left and right side edges of the bottom of the front section and extending toward the rear edge thereof. The straight section has a first end and a second end, the first end of the straight section in communication with the second end of the curved section and the second end of the straight section being a second predetermined distance D2 from the rear edge of the bottom of the front section. Also provided on the bottom of the front section are at least one guide slot parallel to the left and right side edges of the bottom of the front section, a front wall positioned along the front edge of the bottom of the front section, and, a track parallel to the left and right side edges. The track has one end adjacent to the rear edge of the bottom of the front section and extends a third predetermined distance D3 from the rear edge of the bottom of the front section toward the front wall.

The tray extension includes a bottom aligned with the bottom of the front section, the bottom of the tray extension having a front edge, a rear edge, a left edge, a right edge, and a cutout. A rear wall is positioned along the rear edge of the bottom of the tray extension and forming at least in part a rear end of the cutout. At least one guide rail is provided on the bottom of the tray extension parallel to the left and right edge of the tray extension and is slidably received in the at least one guide slot. A spring-biased cam is rotatably attached to a bottom surface of the bottom of the tray extension. The cam has a locking notch and a radially extending locking arm slidably received and retained in the J-slot. The cam is biased to a first position where the cam and locking arm are turned toward and engaged with the curved section of the J-slot.

The user-actuated rear media restraint restrains a rear edge of the media when present and is slidably engageable with the track. The rear media restraint has a first state latched to the track, and, when actuated, a second state unlatched from the track allowing the media restraint to slide along the track. The media restraint includes a bottom plate having a locking lobe extending from a side edge of the bottom plate that is sized to be received in the locking notch of the cam.

With the locking arm engaged with the curved section of the J-slot, the tray extension is locked to the front section. With the media restraint in the second state, upon rearward sliding of the media restraint on the track from a position inboard of the curved section of the J-slot toward the rear edge of the front section, the media restraint moves independently of the tray extension. Upon continued rearward sliding, the locking lobe encounters the locking notch and rotates the cam away from its first position moving the locking arm to a position to enter the first end of the straight section of the J-slot. Upon further rearward sliding, the locking lobe engages with the locking notch and the locking arm enters the straight portion of the J-slot locking the media restraint and tray extension together and unlocking the tray extension from the front section. Upon continued rearward sliding, the rear media restraint enters the cutout in the bottom of the tray extension and the media restraint and the tray extension slide rearward together with the locking arm travelling within the straight section of the J-slot.

Upon forward sliding of the rear media restraint on the track from a position outboard the curved portion of the J-slot toward the front wall, the media restraint and the tray extension move together. Upon further forward sliding, the locking arm enters the second end of the curved section of the J-slot and the locking lobe releases from the locking notch. Upon still further forward sliding, the cam rotates back to its first position due to the spring biasing. The locking arm enters the curved section of J-slot and the media restraint releases from the tray extension and moves independently thereof with the tray extension locked in place to the front section of the removable media tray.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings.

FIG. 7 is a top view of the cam and FIG. 8 is a bottom view of the cam.

FIG. 11A illustrates the media restraint in its first or engaged or latched position and FIG. 11B illustrates the media restraint in an actuated or disengaged or unlatched position.

FIG. 12A shows the first or latched position and FIG. 12B shows the second or unlatched position.

FIG. 14A shows the rear media restraint at its most forward position; FIG. 14B shows the rear media restraint slid rearward at a second position initially engaged with a cam on the tray extension; FIG. 14C shows the rear media restraint slid further rearward and locked to the cam of the tray extension; and, FIG. 14D shows the rear media restraint and tray extension slid to fully extended positions.

DETAILED DESCRIPTION

Figure 1:
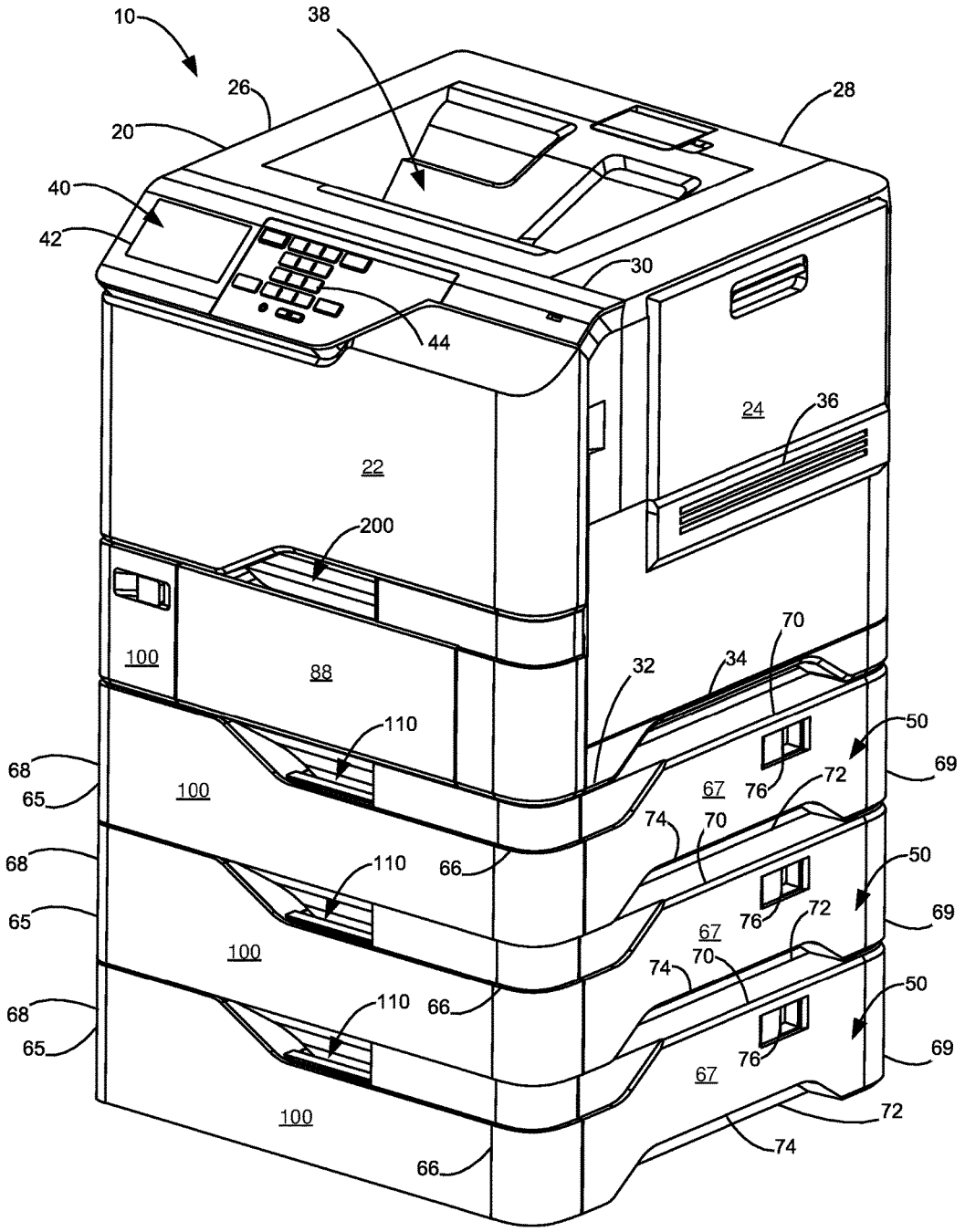
FIG. 1 is an illustration of an imaging device having a removable media tray with the imaging device attached to a stack of option assemblies each having a removable media tray.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise. The use of "including", "comprising", or "having" and variations thereof herein is meant to encompass the items listed thereafter and equivalents thereof as well as additional items.

Terms such as "about" and the like have a contextual meaning, are used to describe various characteristics of an object, and have their ordinary and customary meaning to persons of ordinary skill in the pertinent art. Terms such as "about" and the like, in a first context mean "approximately" to an extent as understood by persons of ordinary skill in the pertinent art; and, in a second context, are used to describe various characteristics of an object, and in such second context mean "within a small percentage of" as understood by persons of ordinary skill in the pertinent art.

Unless limited otherwise, the terms "connected", "coupled", and "mounted", and variations thereof herein are used broadly and encompass direct and indirect connections, couplings, and mountings. In addition, the terms "connected" and "coupled" and variations thereof are not restricted to physical or mechanical connections or couplings. Spatially relative terms such as "left", "right", "top", "bottom", "front", "back", "rear", "side", "under", "below", "lower", "over", "upper", and the like, are used for ease of description to explain the positioning of one element relative to a second element. These terms are intended to encompass different orientations of the device in addition to different orientations than those depicted in the figures. Relative positional terms may be used herein. For example, "superior" means that an element is above another element. Conversely "inferior" means that an element is below or beneath another element. Further, terms such as "first", "second", and the like, are also used to describe various elements, regions, sections, etc. and are also not intended to be limiting. Where possible, like terms refer to like elements throughout the description. A plurality of different structural components may be utilized to implement the media restraint of the present disclosure. Furthermore, and as described in subsequent paragraphs, the specific mechanical configurations illustrated in the drawings are intended to be example embodiments of the present disclosure and that other alternative mechanical configurations are possible.

"Media" or "media sheet" refers to a material that receives a printed image or, with a document to be scanned, a material containing a printed image. The media is said to move along a media path, a media branch, and a media path extension from an upstream location to a downstream location as it moves from the media trays to the output area of the imaging system. For a top feed option tray, the top of the option tray is downstream from the bottom of the option tray. Conversely, for a bottom feed option tray, the top of the option tray is upstream from the bottom of the option tray. As used herein, the leading edge of the media is that edge which first enters the media path and the trailing edge of the media is that edge that last enters the media path. Depending on the orientation of the media in a media tray, the leading/trailing edges may be the short edge of the media or the long edge of the media, in that most media is rectangular. As used herein, the term "media width" refers to the dimension of the media that is transverse to the direction of the media path. The term "media length" refers to the dimension of the media that is aligned to the direction of the media path. "Media process direction" describes the movement of media within the imaging system, and generally means from an input toward an output of the imaging device. The terms "front", "rear", "left", and "right" as used herein for the removable media tray and its components are with reference to the removable media tray being inserted in the imaging device or option assembly as viewed in FIG. 1.

FIG. 1 illustrates an example imaging device 10 atop three example option assemblies 50. Imaging device 10 has a housing 20 having a front 22, a first and second sides 24, 26, a rear 28, a top 30 and a bottom 32 and into which a removable media tray 100 is slidably inserted. Option assembly 50 has a housing 65 having a front 66, first and second sides 67, 68, a rear 69, a top 70 and a bottom 72 and into which removable media tray 100 is also slidably inserted. A user interface 40, comprising a display 42 and a key panel 44, may be located on the front 22 of housing 20. Using the user interface 40, a user is able to enter commands and generally control the operation of the imaging device 10. For example, the user may enter commands to switch modes (e.g., color mode, monochrome mode), view the number of images printed, take the imaging device 10 on/off line to perform periodic maintenance, and the like. A media output area 38 for receiving printed media is provided in the top 30. A multipurpose input tray 88 folds out from the front of the removable media tray 100 in imaging device 10 and may be used for handling envelopes, index cards or other media where only a small number of the media will be printed. The multipurpose tray 88 may also be incorporated into front 22 of housing 20 rather than being incorporated into removable media tray 100. Hand grips 34, 74 are provided in several locations on housings 20, 65, respectively, such as on sides 24, 26, 67, 68. Also, ventilation openings, such as vents 36 are provided on imaging device 10 such as those shown on first side 24. Latches 76 are provided on each option assembly 50 to secure it to either imaging device 10 or a superior option assembly 50 in the stack.

The option assemblies 50 are stackable allowing one or more option assemblies 50 to be used with a single imaging device 10 that is typically positioned on top of the uppermost option assembly 50 in the stack. Option assemblies 50 may be removed or added to the stack. As each option assembly 50 is added, the media path is extended. Typically, each option assembly 50 may contain a different type of media such as letterhead or a different size such as A4 or a larger quantity of the same media type that is found in the removable media tray 100 integrated into imaging device 10. Each removable media tray 100 is sized to contain a stack of media sheets that will receive color and/or monochrome images. Each removable media tray 100 may be sized to hold the same number of media sheets or may be sized to hold different quantities of media sheets. Example media sizes include but are not limited to A6, Letter, A4, and Legal. In some instances, the removable media tray 100 in imaging device 10 may hold a lesser, equal or greater quantity of media than a removable media tray 100 found in an option assembly 50.

Figure 2:
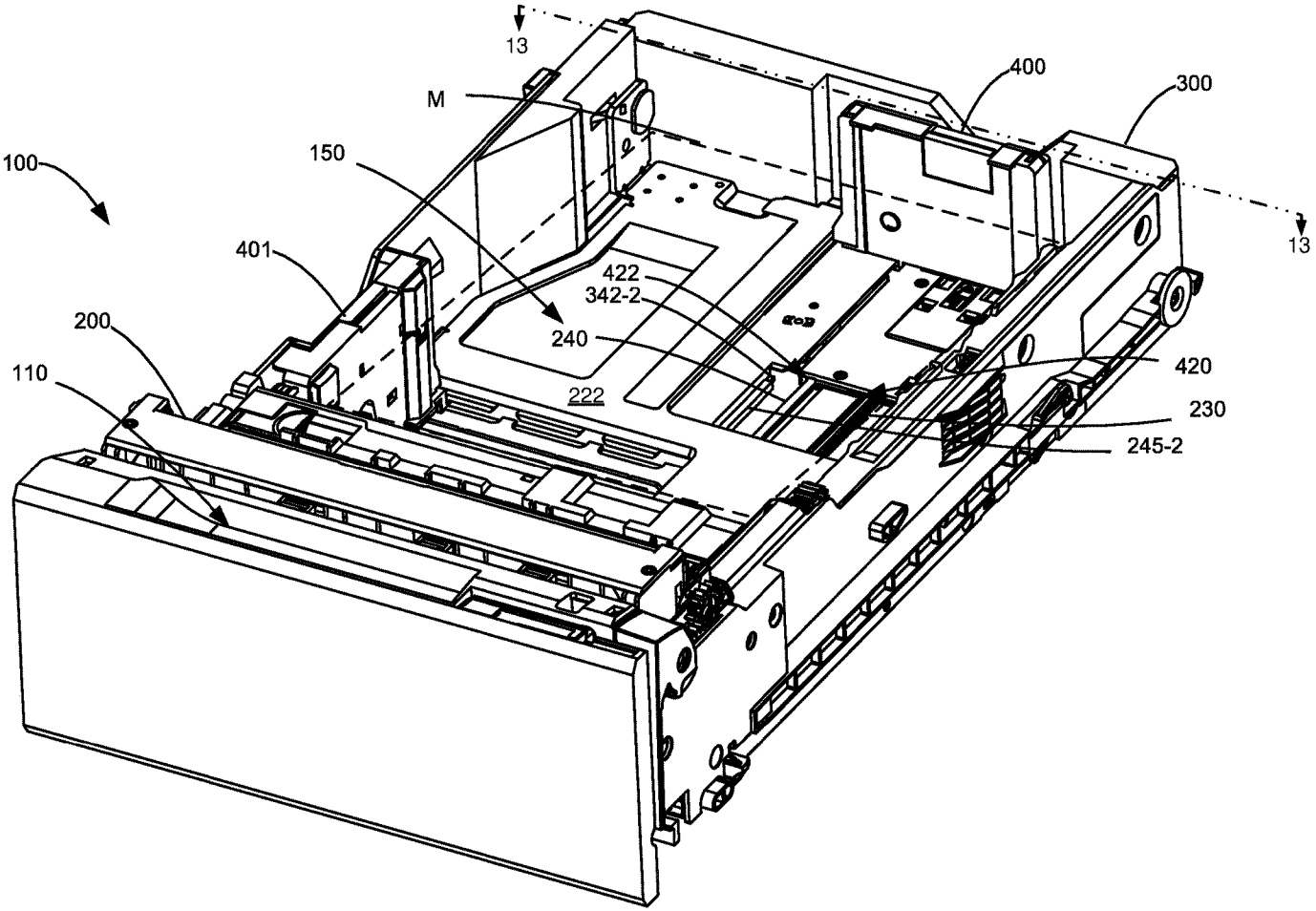
FIG. 2 is a perspective illustration of a removable media tray for the imaging device of FIG. 1 having a front section and a rear tray extension along with a rear and a side edge media restraint.

Referring to FIG. 2, removable media tray 100 is shown. As illustrated, removable media tray 100 is sized to hold approximately 550 pages of 20 pound media which has a media stack height of about 59 mm. A handle 110 is provided at the front of removable media tray 100 for removing and inserting removable media tray 100 into imaging device 10 or option assembly 50. Removable media tray 100 has front section 200 and a tray extension 300 forming an expandable media storage area 150. Tray extension 300 is slidably attached to front section 200. Provided in each removable media tray 100 are one or more adjustable media restraints. A rear media restraint 400 and side media restraint 401 are shown placed at a rear and a side edge of the media storage area 150, to accommodate for different media lengths and widths. A media sheet M, shown in dashed line, is positioned in media storage area 150 having a rear edge abutting rear media restraint 400 and a left side edge abutting side media restraint 401. Media storage area has an initial length L1 (see FIG. 16) when tray extension 300 is in its retracted position abutting the rear edge 202-1 of bottom 202. Length L1 may be in the range of about 311 mm to about 314 mm. When tray extension 300 is fully extended, length L1 increases to about 360 mm for the example embodiment of removable media tray 100. However, these values should not be considered as limiting and are a matter of design choice and longer media lengths than those illustrated may be used.

Figure 3:
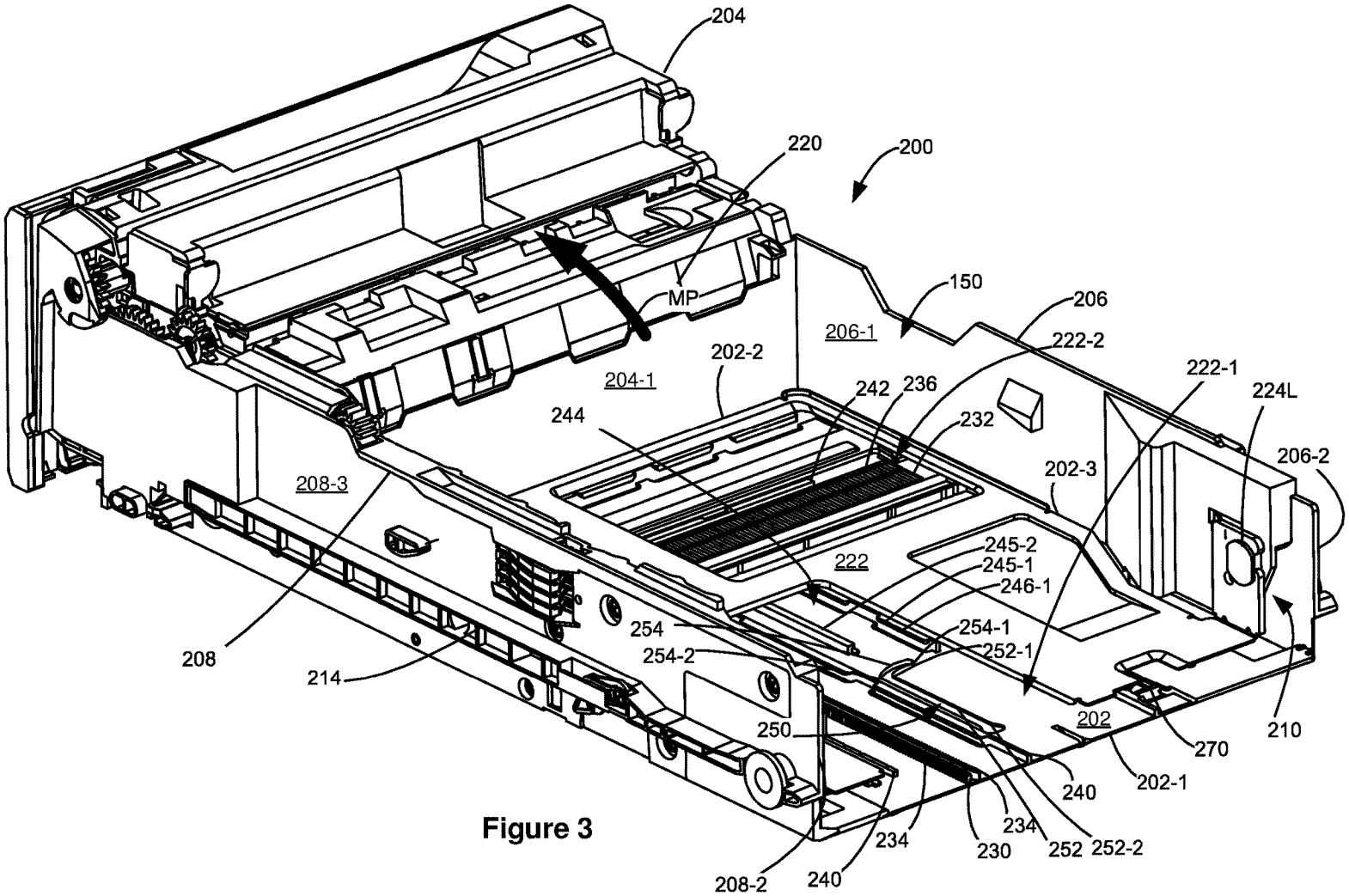
FIG. 3 is a top and right side perspective view of the front section of the removable media tray of FIG. 2.
Figure 4:
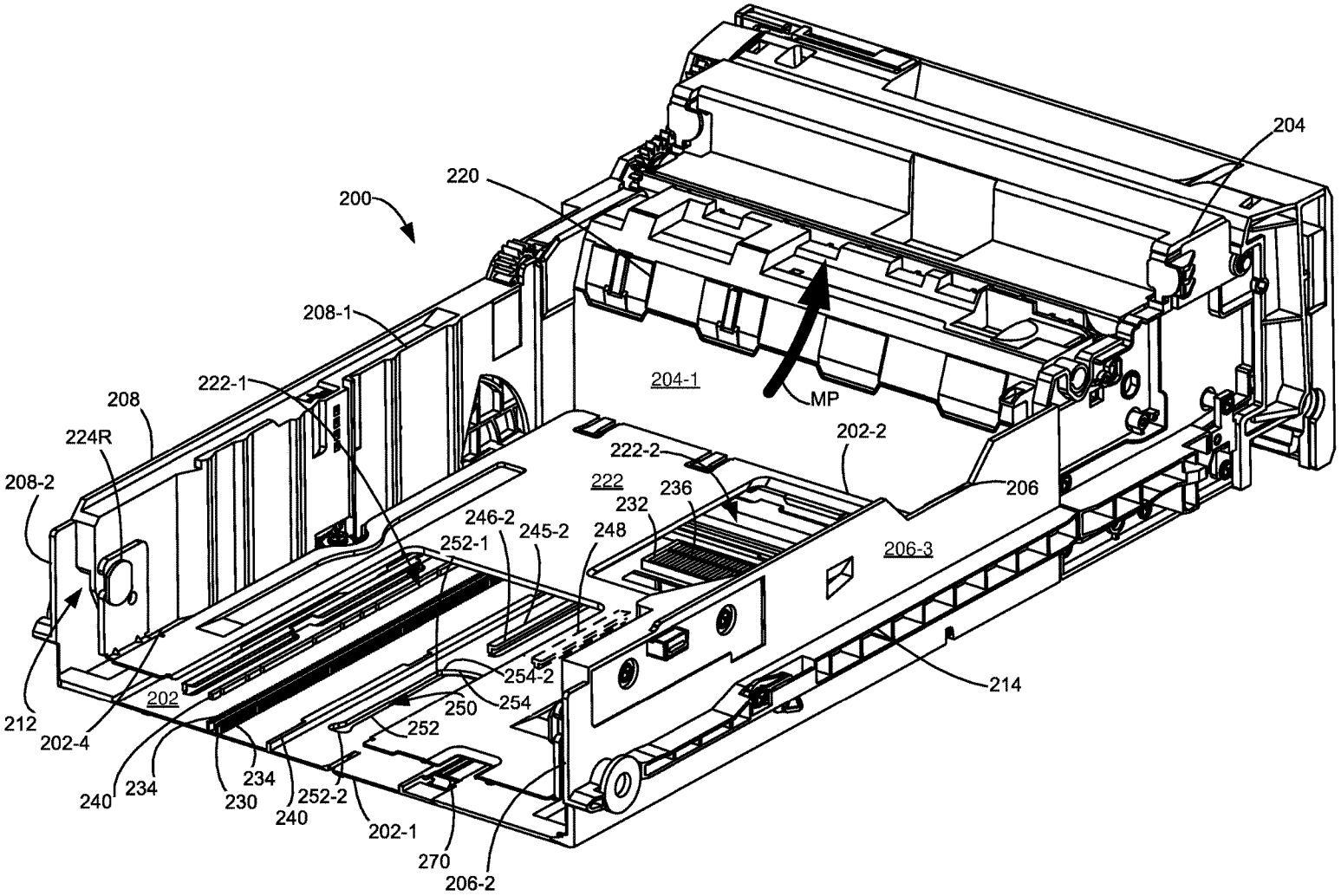
FIG. 4 is a top and left side perspective view of the front section of the removable media tray of FIG. 2.

Referring to FIGS. 3-4, front section 200 of removable media tray 100 is shown. Front section 200 has a bottom 202 having a front wall 204, a left side wall 206 and a right side wall 208 mounted on bottom 202. Walls 204, 206, 208 may be integrally molded with bottom 202. Media storage area 150 is generally defined by bottom 202 and walls 204, 206, 208. Bottom 202 further has a rear edge 202-1 and a front edge 202-2 that for purposes of description lies at the intersection of an inner face 204-1 of front wall 204 and bottom 202. Similarly, left and right edges 202-3, 202-4 of bottom 202 are at the intersection inner faces 206-1, 208-1 of left and right side walls 206, 208, respectively. Pockets 210, 212 may be provided in left and right side walls 206, 208 adjacent the respective rear ends 206-2, 208-2 thereof. Pockets 210, 212 receive therein corresponding side walls, when present, of tray extension 300 when it is in its retracted position with respect to front section 200. Rails 214 may be provided on the outer faces 206-3, 208-3 of left and right side wall 206, 208 for aiding insertion and removal of removable media tray 100.

A media dam 220 is provided in an upper portion of front wall 204 and is used to deflect media being fed from removable media tray 100 into the media path indicated by the arrow MP. A lift plate 222, used to raise a media stack, is shown pivotally attached to left and right side walls 206, 208 at pivot posts 224L, 224R, respectively.

Figure 16:
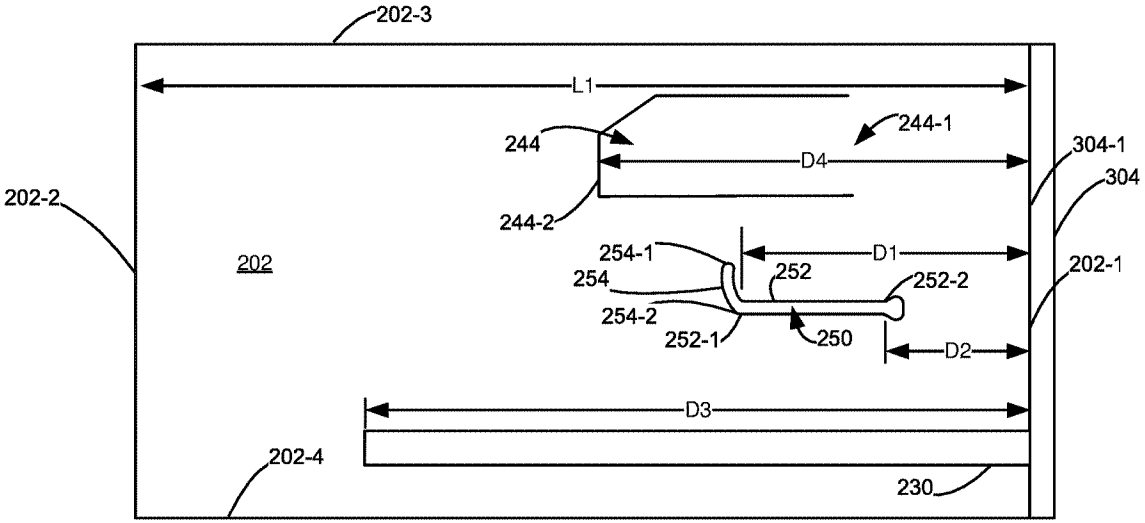
FIG. 16 is a schematic illustration of the front section of the removable media tray illustrating lengths and distances of features found in the front section.

Media restraints 400, 401 are latchable and slidable along respective tracks 230, 232 provided on bottom 202. Tracks 230, 232 have serrations 234,236, respectively, along their lengths that allow media restraints 400, 401 to be latched into user selected locations. Serrations 234 are vertically oriented while serrations 236 are horizontally oriented. As shown in FIG. 16, track 230 extends a predetermined distance D3 from the rear edge 202-1 toward the front edge 202-2 and parallel to the left and right edges 202-3, 202-4 of bottom 202. Track 232 extends a position adjacent left edge 202-3 toward right side edge 202-4 parallel to rear and front edges 202-1, 202-2 of bottom 202. Track 230 allows the rear media restraint 400 to be adjusted between the shortest designed-for media length, such as A6 media, and the longest designed-for media length, such as Legal. Similarly, track 232 allows for side edge media restraint 401 to be adjusted between the narrowest and widest designed-for media sizes. Distance D3 may be in the range of about 250 mm to about 252 mm to accommodate media lengths between 148 mm to about 356 mm. The length of track 232 may be in the range of 90 mm to about 227 mm to accommodate media widths in the range of 105 mm to 216 mm. Longer or shorter track distances for other media widths and lengths may be used and the recited values should not be considered as limiting.

Guide rails 240 may be provided parallel to track 230 and may also be referred to as longitudinal guide rails. Guide rails 242 may be provided parallel to track 232 and may also be referred to as transverse guide rails as they are transverse to the media path. A wide guide slot 244 formed by left and right longitudinal rails 245-1, 245-2 on the bottom 202 is parallel to track 230. As shown in FIG. 16, wide guide slot 244 has an open rear end 244-1 facing the rear edge 202-1 of bottom 202 and a closed front end 244-2 at a predetermined distance D4 from rear edge 202-1. Distance D4 may be in the range of about 188 mm to about 190 mm and is given for purposes of illustration not limitation. Longitudinal rails 245-1, 245-2 have top flanges 246-1, 246-2, respectively, and are positioned beginning inboard or forward of a J-slot 250 provided in bottom 202 and extend for a short distance. A longitudinal T-rail 248 is positioned between rail 245-1 and left edge 202-3 of bottom 202, inboard of J-slot 250, and extending a short distance toward front edge 202-2. Rails 245-1, 245-2, and 248 engage with corresponding guide structures provided on the bottom of tray extension 300.

J-slot 250 has a straight section 252 and a curved section 254 and is used with a cam provided on tray extension 300 to lock tray extension 300 to front section 200 as detailed later. Curved section 254 has first and second ends 254-1, 254-2 that are on a line that is generally parallel to rear edge 202-1 of bottom 202 at a first predetermined distance D1 as shown in FIG. 16. Straight section 252 extends toward rear edge 202-1 of bottom 202 and is parallel to track 230. Straight section 252 has first and second ends 252-1, 252-2 where first end 252-1 is in communication with second end 254-2 of curved section 254 and second end 252-2 is adjacent to rear edge 202-1 at a predetermined distance D2 (see FIG. 16). Second end 252-2 may have a portion that is enlarged as shown to allow a radial extension member 358 (see FIG. 7) extending from the cam 350 on tray extension 300 to be inserted into J-slot 250 during assembly of removable media tray 100. An inner wall 250-1 of J-slot 250 may also be outwardly beveled as shown in FIGS. 15A-15E. Distance D1 may be in the range of about 96 mm to about 97 mm and distance D2 may be in the range of about 38 mm to about 40 mm. Again, the distances stated are for purposes of illustration and not limitation Also provided on bottom 202 is a flexible hook 270 that will engage with a catch 370 provided in tray extension 300 (see FIG. 6) when the tray extension 300 and media restraint 400 have reached the longest designed-for media length. The front edge 370-2 of catch 370 is beveled allowing it to depress and slide over hook 270 when tray extension 300 is installed into front section 200 after which hook 270 snaps back to its original position. The rear edge 370-1 of catch 370 is vertical or squared-off and will contact and engage hook 270 should a user try to extend tray extension 300 beyond its maximum designed-for media length. To remove tray extension 300, hook 270 may be manually depressed allowing catch 370 to slide back over it as tray extension 300 is removed from front section 200.

Removable media tray 100 is an edge referenced media tray meaning that the media is positioned against the front wall 204 and one of the side walls 206, 208 and aligned with the side wall that is being used as the reference edge. As shown, right side wall 208 serves as the reference edge. Media restraints 400, 401 act to bias and align the media with respect to the front and right side walls 204, 208, respectively. Openings 222-1, 222-2 are provided in lift plate 212 to allow for travel of media restraints 400, 401, respectively along tracks 230, 232, respectively. Removable media tray 100 may also be a center referenced removable media tray where a left and a right side media restraint are provided and are used to center the media along the media path. The tray extension 300 and rear media restraint 400 of the present disclosure may be used with either design of removable media tray.

Figure 5:
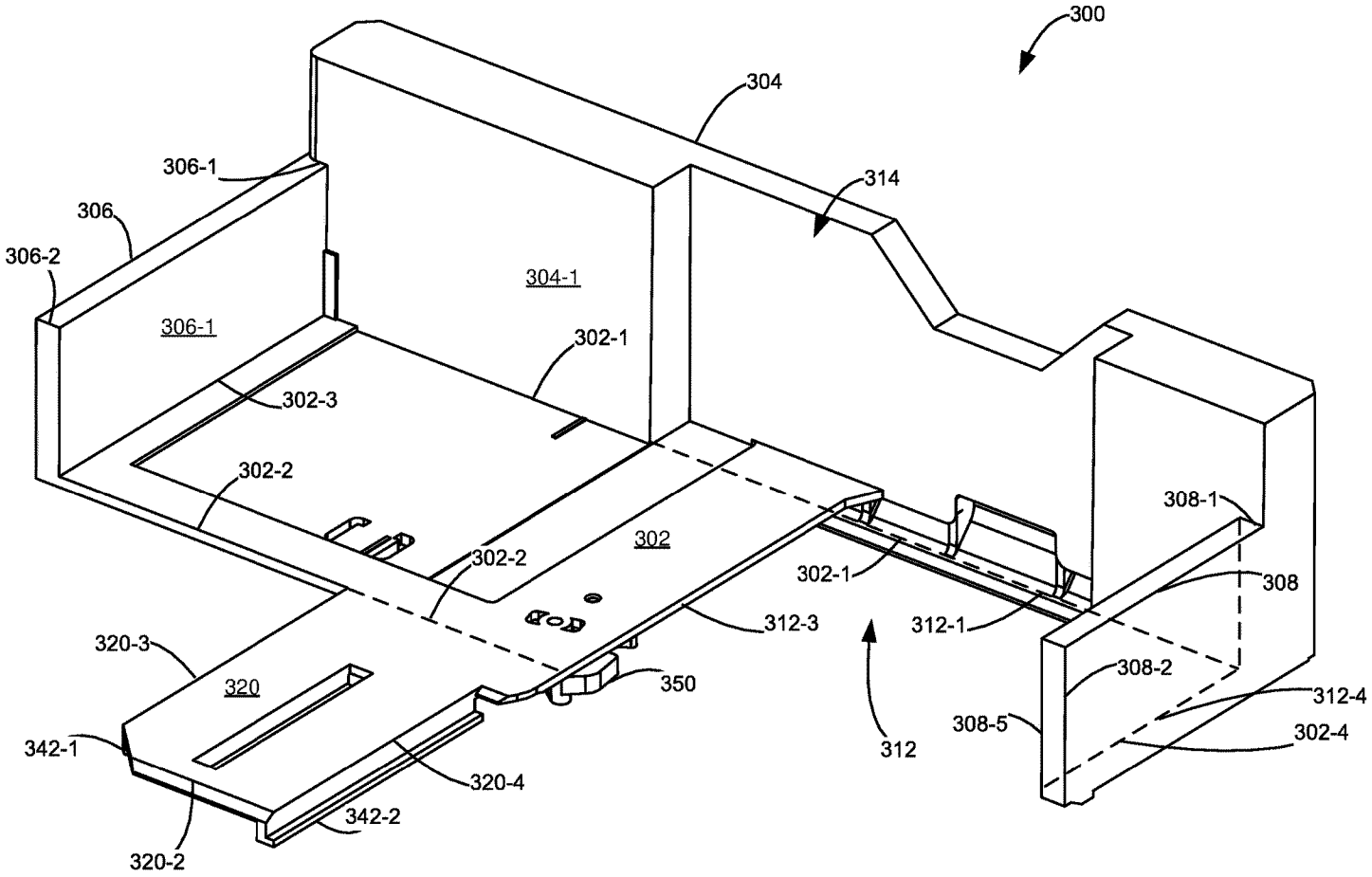
FIG. 5 is a top and right side perspective view of the tray extension of FIG. 2.
Figure 6:
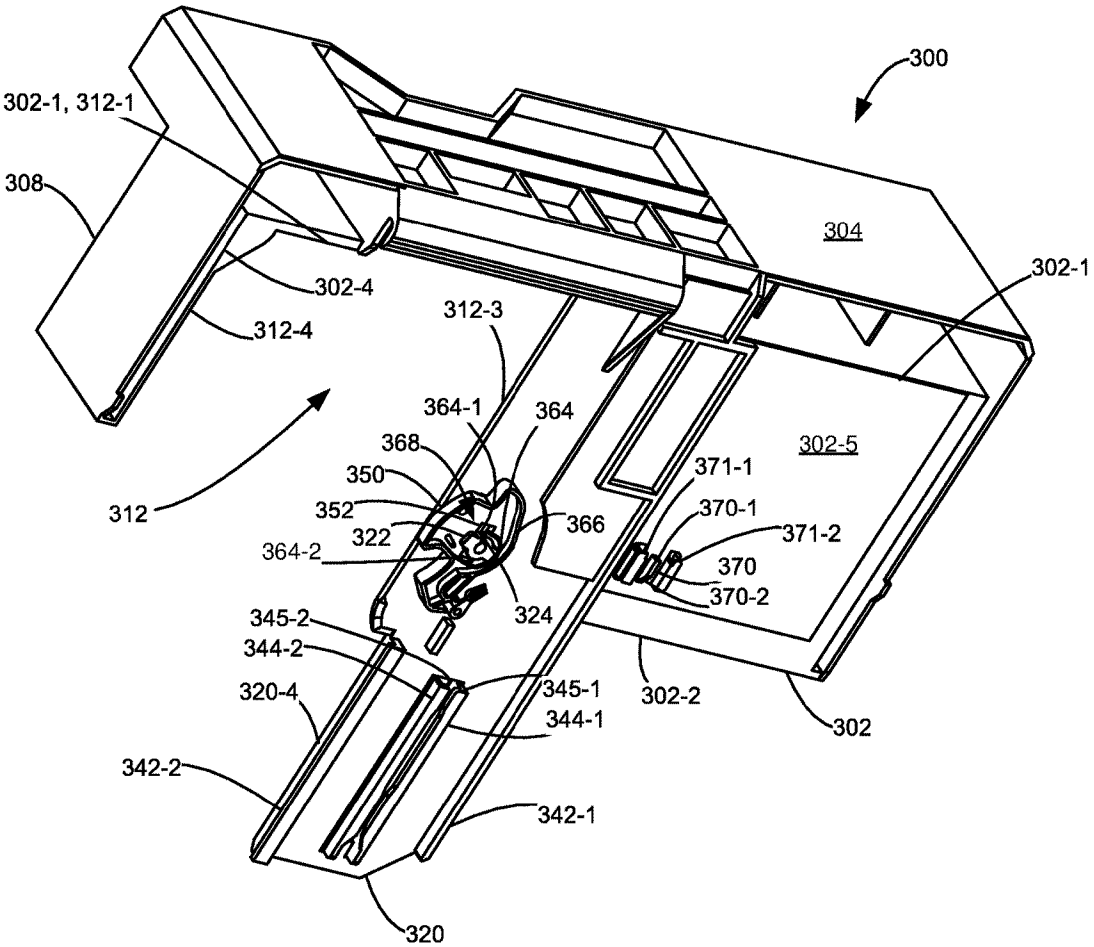
FIG. 6 is a bottom and right side perspective view of the tray extension of FIG. 2.
Figure 17:
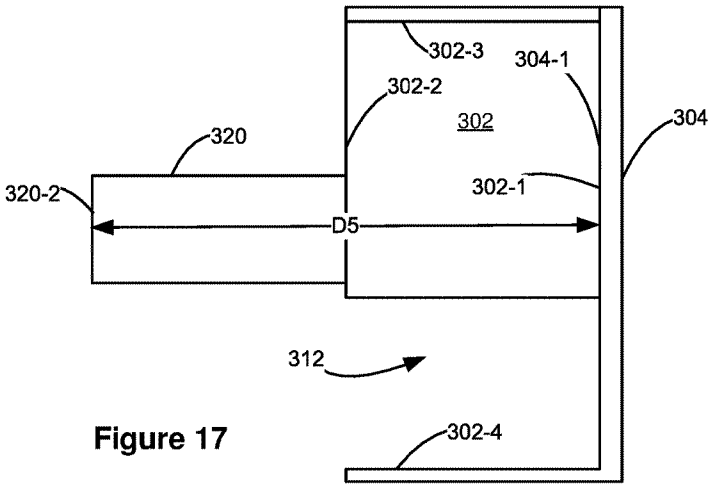
FIG. 17 is a schematic illustration of the tray extension of the removable media tray illustrating lengths and distances of features found in the tray extension.

Tray extension 300 is shown in FIGS. 5-6 and 17. Tray extension 300 has a bottom 302 aligned with the bottom 202 of the front section 200 when tray extension 300 is installed. The bottom 302 of the tray extension 300 has a rear edge 302-1, a front edge 302-2, a left edge 302-3 and a right edge 302-4 as viewed from the direction of insertion of removable media tray 100 into imaging device 10 or an option assembly 50. A rear wall 304 and a left wing wall 306 and a right wing wall 308 depend from bottom 302 of tray extension 300. Left wing wall 306 has a rear edge 306-1 that abuts rear wall 304 and a front edge 306-2. Right wing wall 308 has a rear edge 308-1 that abuts rear wall 304 and a front edge 308-2. The rear wall 304 is positioned along the rear edge 302-1, the left wing wall 306 along the left edge 302-3 and the right wing wall 308 along the right edge 302-4 of the bottom 302 of tray extension 300.

Figure 14A:
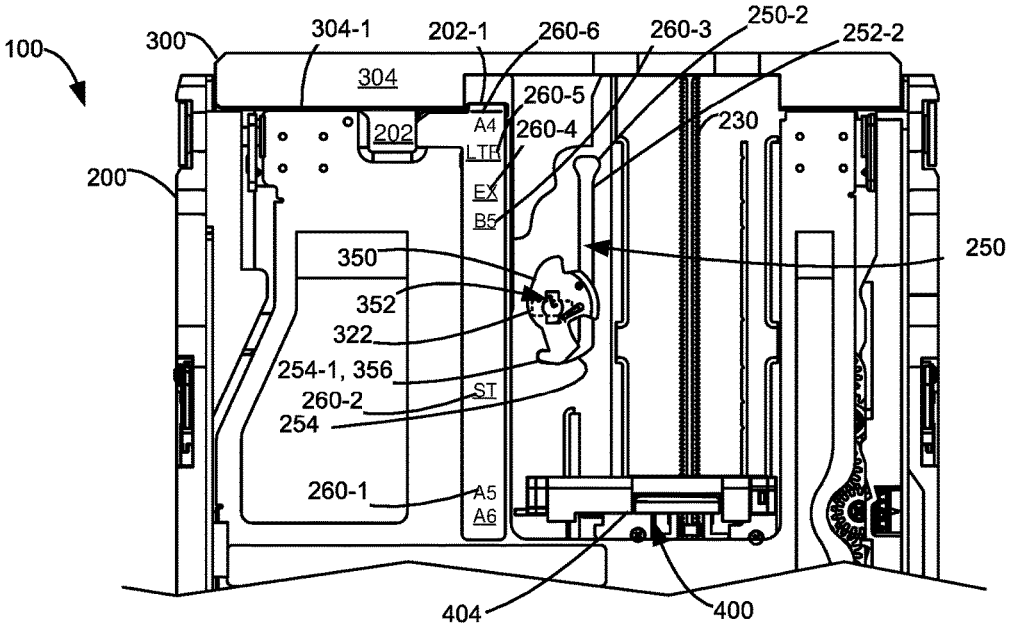
FIGS. 14A-14D are partial plan views of the removable media tray of FIG. 2 showing the movement of the rear media restraint where
Figure 14B:
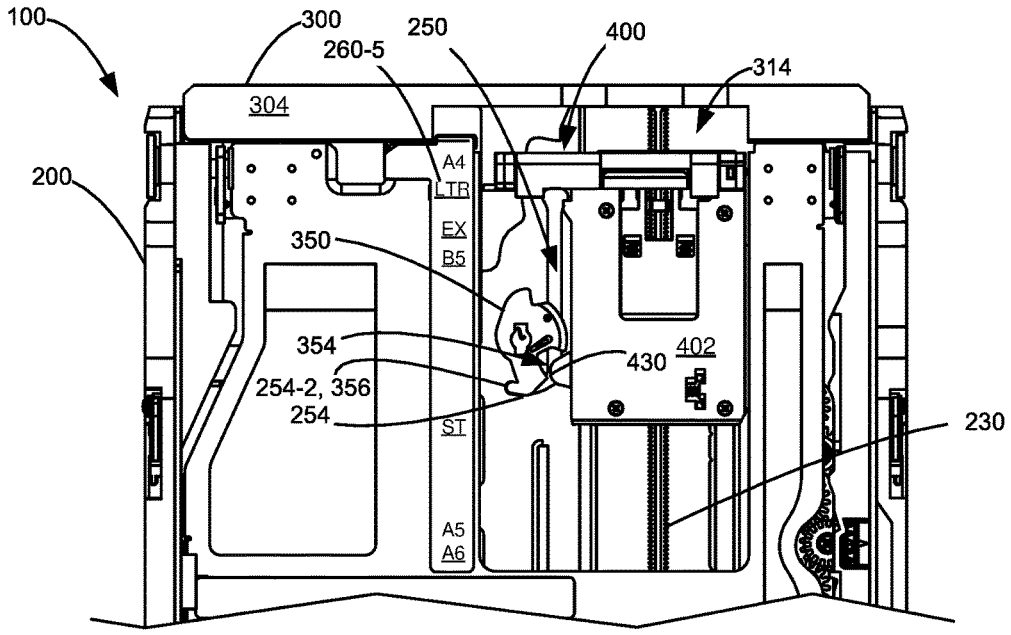
Figure 14C:
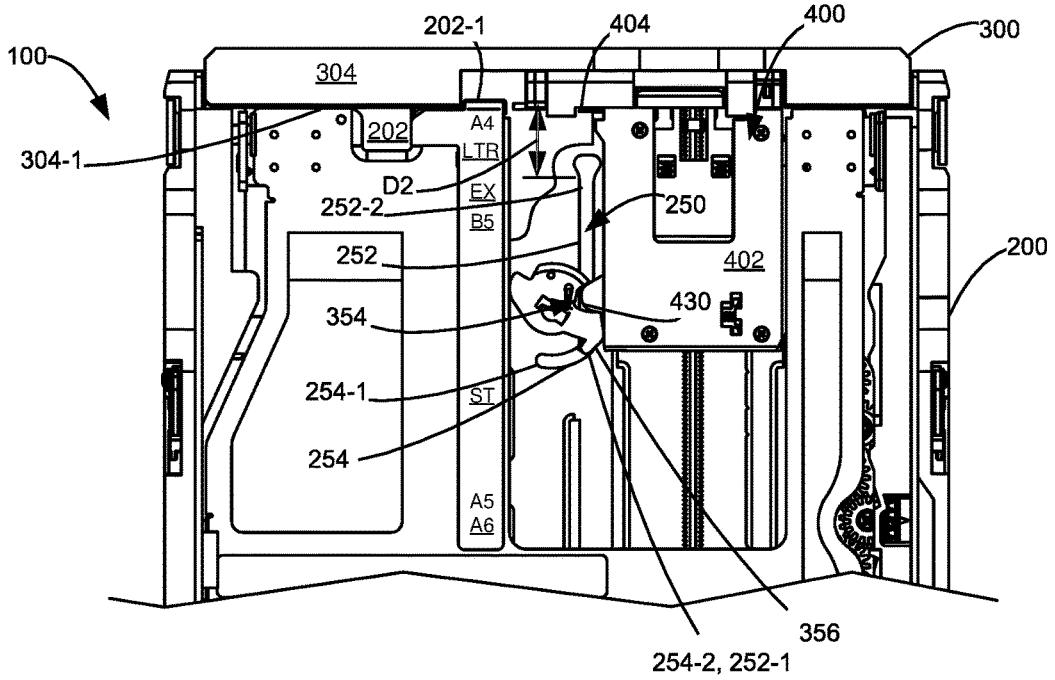
Figure 14D:
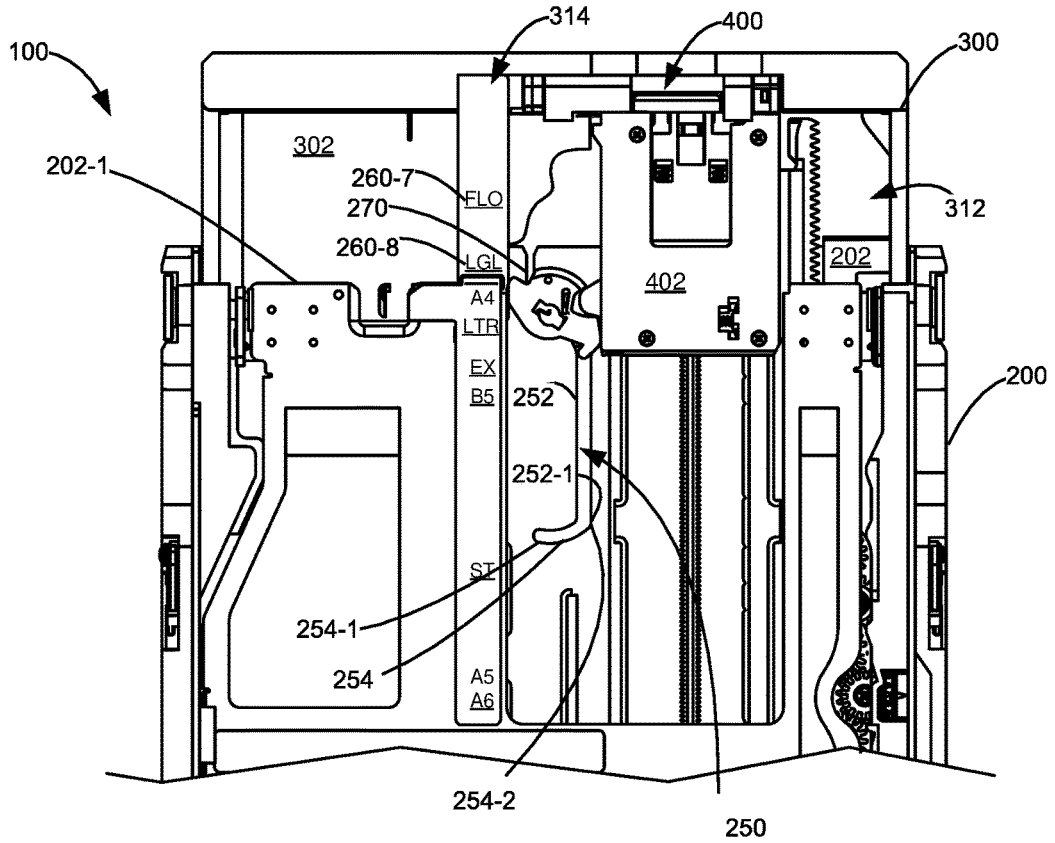

A cutout 312 is provided in bottom 302 and a rear end 312-1 of the cutout 312 is formed by rear wall 304. Cutout 312 has a left edge 312-3 and a right edge 312-4 formed by the inner surface 308-5 of right wing wall 308. A recess 314 is provided in the inner face 304-1 of rear wall 304. Recess 314 and cutout 312 are sized to receive media restraint 400 therein as shown in FIGS. 14C-14D as tray extension 300 reaches an intermediate designed-for media length, such as A4 and is then moved to one or more extended positions. With tray extension 300 in one of the extended positions, the bottom plate 402 of media restraint 400 provides an additional support surface for the longer designed-for media lengths when present in removable media tray 100.

Extending from front edge 302-2 of bottom 302 is a front projection 320 that is received in wide guide slot 244. Front projection 320 has an angled front edge 320-2 to aid in initial assembly of removable media tray 100, a left edge 320-3 that is inset from left edge 302-3 of bottom 302, and a right edge 320-4 that is inset from the left edge 312-3 of cutout 312. Front edge 320-2 is a predetermined distance D5 from the rear edge 202-1 of bottom 202 or the inner face 304-1 of rear wall 304 of tray extension 300. Distance D5 may be in the range of about 187 mm to about 189 mm. Again, the range of values is only for purposes of illustration and not limitation.

Provided on the undersurface 302-5 of bottom 302 is at least one guide rail positioned parallel to the left and right edges 302-3, 302-4 of the bottom 302 of tray extension 300. Four guide rails are shown. Left and right guide rails 342-1, 342-2 are received in wide guide slot 244 between left and right rails 245-1, 245-2 (see FIG. 2 showing the engagement of right rails 245-2, 342-2 with the other rails being hidden by the lift plate 222). Left guide rail 342-1 is illustrated as extending along the left edge 320-3 of front projection 320 to rear edge 302-1 of bottom 302. Right guide rail 342-2 is shown extending along right edge 320-4 of front projection 320. Guide rails 344-1, 344-2, having inwardly directed flanges 345-1, 345-2 at their respective lower ends, receive T-rail 248 when tray extension 300 is inserted into front section 200. Also provided on undersurface 302-5 is a catch 370 having a squared-off rear end 370-1 and a tapered front end 370-2.

Figure 7:
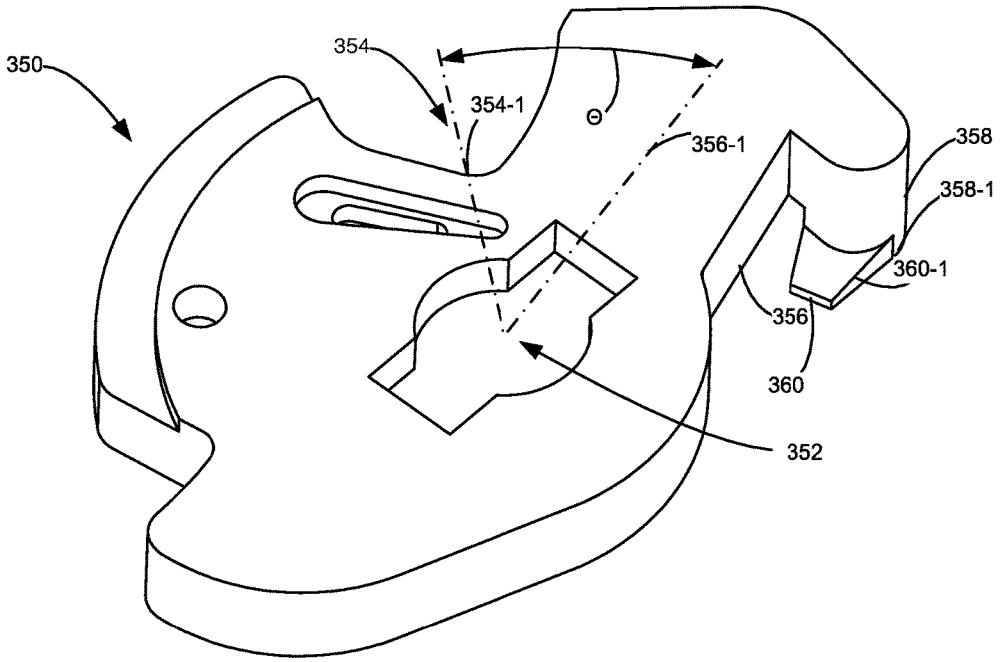
FIGS. 7-8 are perspective views of the cam used on the tray extension of FIGS. 5-6 where
Figure 8:
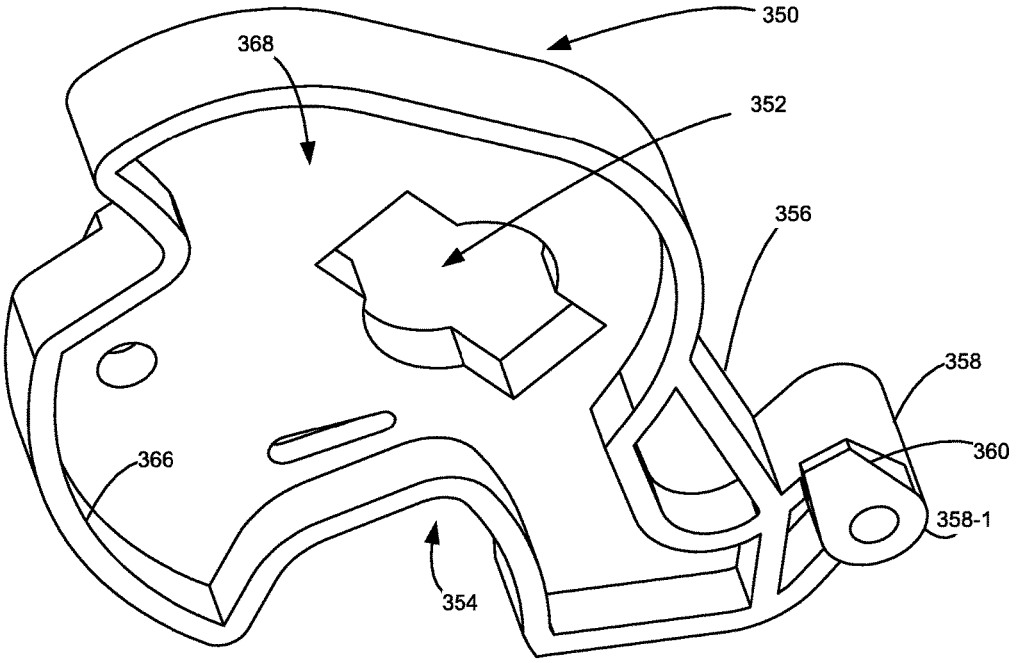

Referring to FIGS. 7-8, cam 350 is planar and generally circular in shape. Cam 350 has a locking notch 354 and a radially extending locking arm 356 that is received into J-slot 250 (e.g., see FIG. 14A). The approximate centerline 354-1 of locking notch 354 is at an angle Θ away from the approximate centerline 356-1 of locking arm 356. The angle Θ is in the range of about 32 degrees to about 34.5 degrees. Locking notch 354 engages with a locking lobe 430 on media restraint 400 as explained with reference to FIGS. 14A-14D. Locking notch 354 and locking lobe 430 have substantially similar shapes allowing them to nest together. The distal end 356-1 of locking arm 356 has a locking pin 358 that rides in J-slot 250. Locking pin 358 has at its distal end 358-1 a radial extension member 360 (with respect to locking pin 358) that slidably engages with the beveled inner wall 250-1 of J-slot 250 (see FIGS. 15A-15E). Locking pin 358 and extension member 360 form a hook structure for engaging with bottom 202 of front section 200. An upper surface 360-1 of extension member 360 may be angled to match the bevel of inner wall 250-1 of J-slot 250. Extension member 360 has a length L2 that is greater than the width W1 of J-slot 250 (see FIG. 15D). For purposes of illustration and not limitation, length L2 is in the range of about 6.12 mm to about 6.18 mm while width W1 is in the range of about 5.0 mm to about 5.2 mm.

During assembly of removable media tray 100, extension member 360 is inserted through an enlarged portion 250-2 of J-slot 250 (see FIG. 14A) that is adjacent to the second end 252-2 of the straight portion 252 of J-slot 250. When tray extension 300 is at its maximum extension and during normal use of removable media tray 100, extension member 360 does not normally enter the enlarged portion 250-2 in that the longest designed-for media length shown by an indicator on the bottom 202 of front section 200 occurs at a point prior to the enlarged portion 250-2 of J-slot 250 and at which point hook 270 and catch 370 engage, limiting the maximum extension of tray extension 300. Locking arm 356 keeps tray extension 300 slidably engaged with front section 200 as tray extension 300 is extended and retracted.

Referring to FIG. 6, a keyed post 322 depends from undersurface 302-5 of the bottom 302 of tray extension 300 adjacent to a corner formed between the front edge 302-2 of bottom 302 and left edge 312-3 of cutout 312. Keyed post 322 is positioned outboard of the curved section 254 of J-slot 250 when the tray extension 300 is locked to front section 200. Cam 350, also referred to as a locking cam 350 is rotatably mounted to keyed post 322 and is spring-biased. During assembly of removable media tray 100, a keyed central opening 352 on cam 350 is aligned with keyed post 322 allowing cam 350 to be mounted. A biasing member 364 is attached between cam 350 and keyed post 322. Cam 350 has a circumferential wall 366 forming a recess 368. A first end 364-1 of biasing member 364 is received in notch 324 in keyed post 322. A second end 364-2 of biasing member 364 rests against wall 366 within recess 368. Biasing member 364 rotates cam 350 such that locking arm 356, locking pin 358 and extension member 360 are biased toward the first end 254-1 of the curved section 254 of J-slot 250 as shown in FIGS. 14A, 14B and, as also shown in FIG. 14A, rotates keyed opening 352 with respect to keyed post 322.

Figure 9:
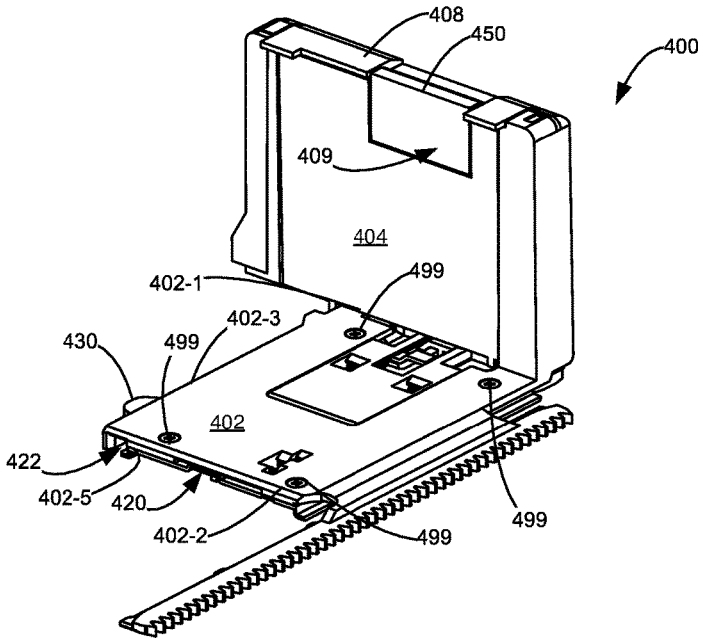
FIG. 9 is a front perspective view of a rear media restraint used in the removable media tray of FIG. 2.
Figure 10:
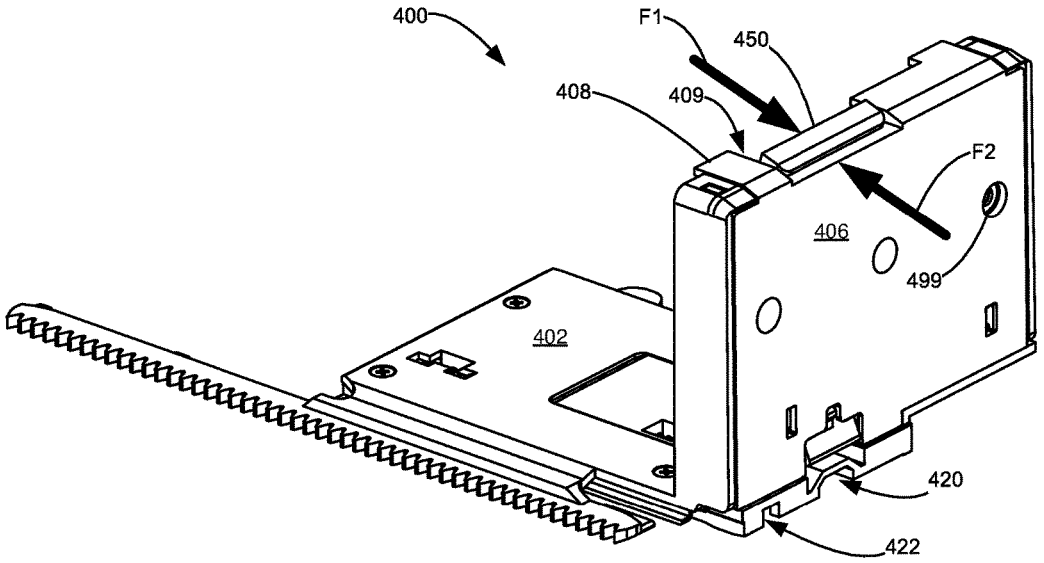
FIG. 10 is a rear perspective view of the rear media restraint of FIG. 9.
Figure 11A:
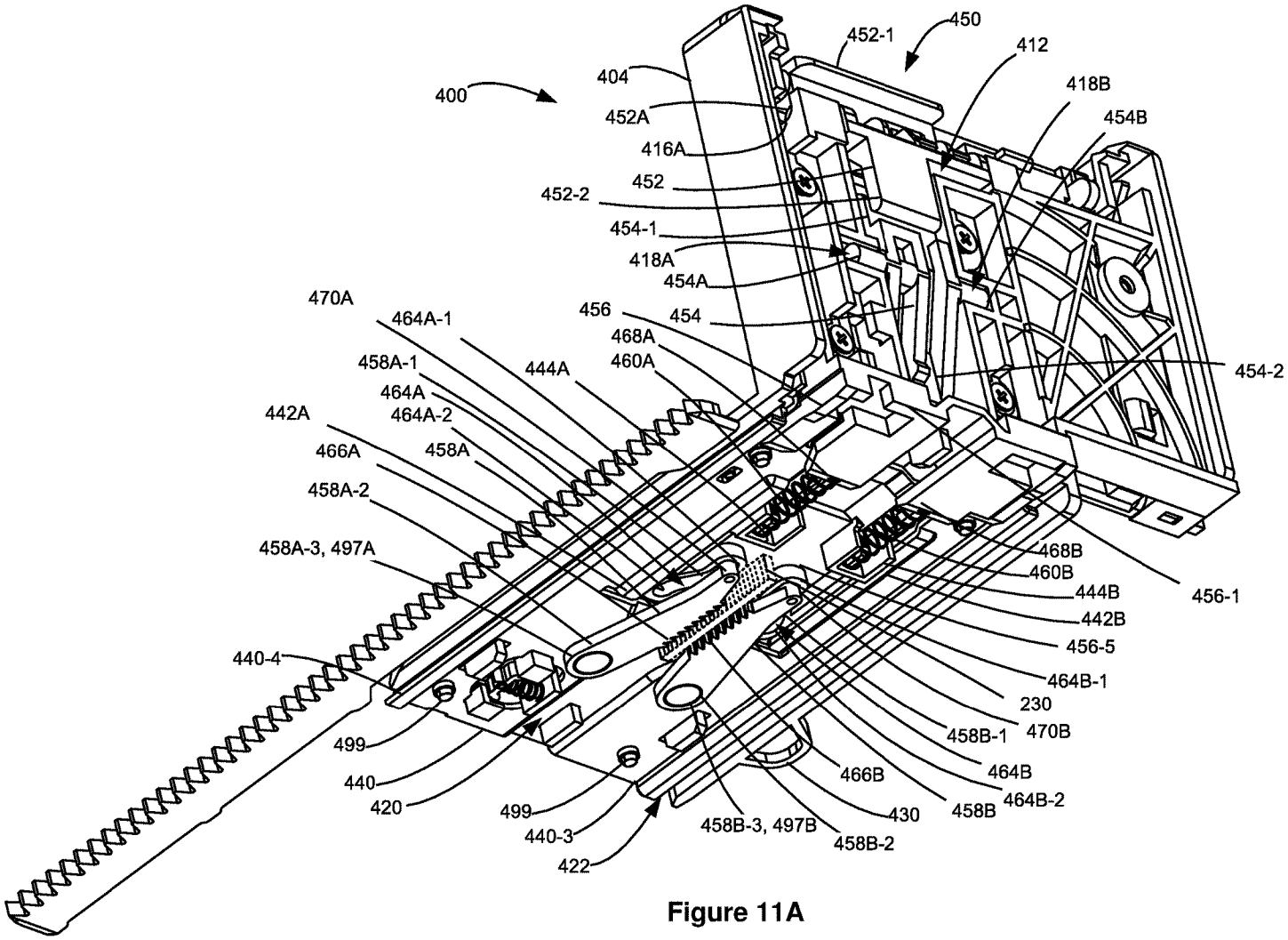
FIGS. 11A-11B are rear perspective views of the media restraint of FIGS. 9-10 having a rear plate removed to show a latching mechanism where
Figure 11B:
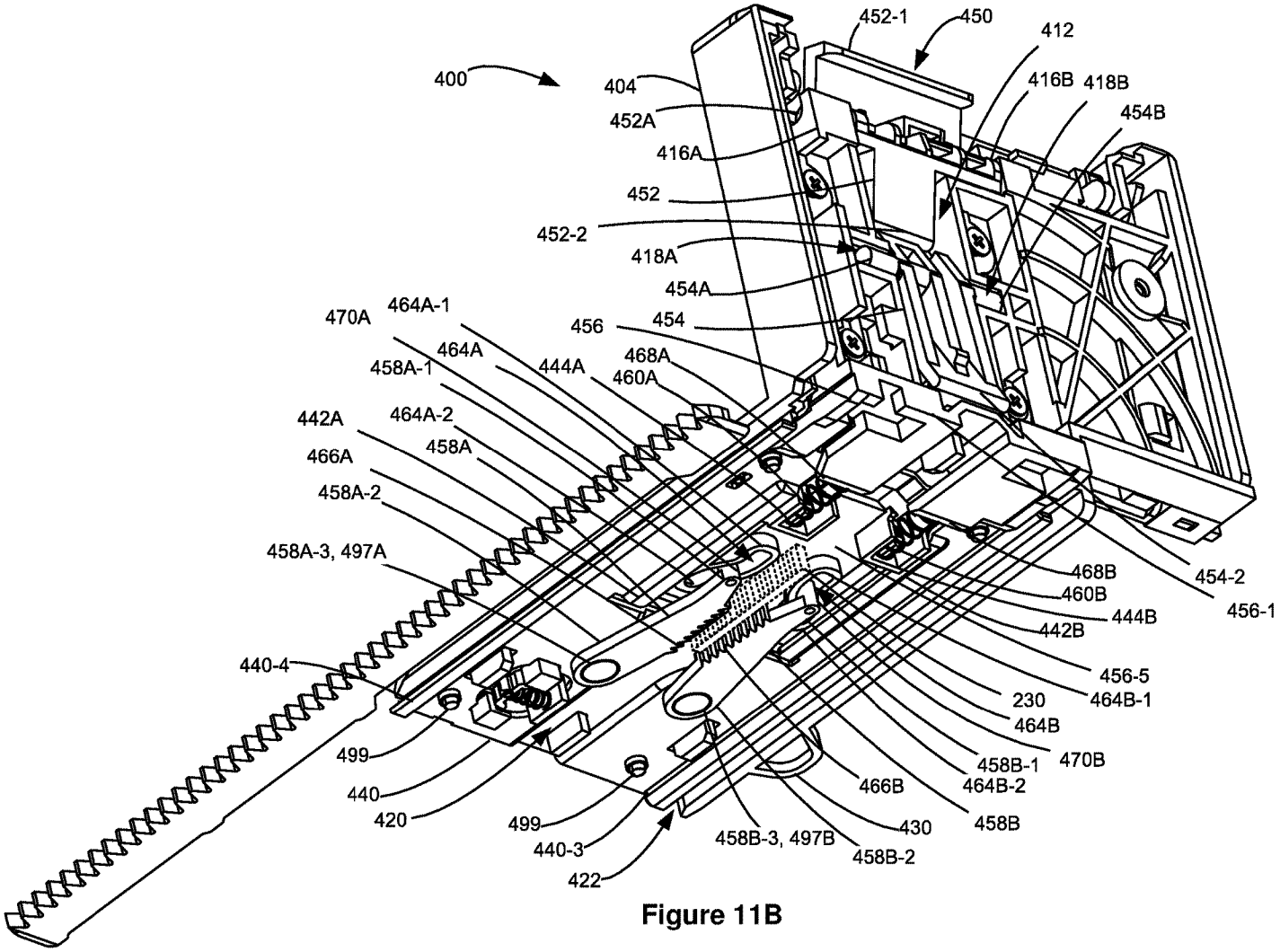
Figure 12B:
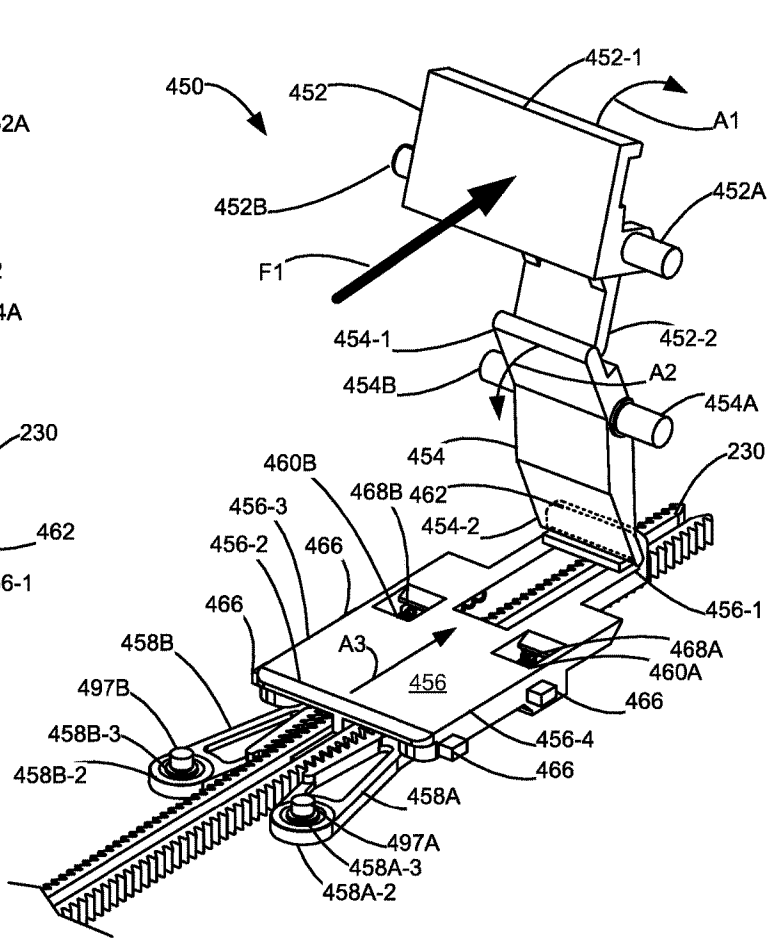
Figure 12B Prior Art
FIGS. 12A-12B are perspective illustrations of the latching mechanism of the media restraint of FIGS. 9-11B where

Referring to FIGS. 9-12B, an example embodiment of media restraint 400 and its components is shown. Media restraint 400 may have several different configurations. However, media restraint 400 should be slidably latchable to track 230, provide a media restraint wall, and engage with cam 450. The latching mechanism used to latch and unlatch media restraint 400 is a matter of design choice and should not be considered as limiting. FIGS. 9 and 11A show media restraint 400 in a first or latched state. FIGS. 10 and 11B show media restraint 400 in an unlatched state. FIGS. 12A-12B show a known example of a latching mechanism 450 in the latched and unlatched states, respectively. As shown in FIG. 10, a pinching force, represented by force vectors F1, F2 applied to the latching mechanism 450 and rear plate 406 is used to unlatch media restraint 400 from track 230 allowing for media restraint 400 to be moved along track 230.

In FIGS. 9-10, example media restraint 400 is shown having a bottom plate 402 on which is mounted a front plate 404, a rear plate 406 spaced from front plate 404, and a top plate 408 that joins front and rear plates 404, 406. Front plate 404 aligns with a rear edge 402-1 of bottom plate 402 and acts as a restraint wall to the rear edge of media placed within media storage area 150 of removable media tray 100. Adjacent the corner formed between front edge 402-2 and left edge 402-3 of bottom plate 402 and extending from left edge 402-3 is the locking lobe 430 having a semi-elliptical shape. Locking lobe 430 is received into and engages with the similarly shaped locking notch 354 of cam 350 during extension and retraction of tray extension 300. As shown in FIG. 2, channels 420, 422 are provided in media restraint 400 for track 230 and guide rail 240, respectively.

A support plate 440 is shown attached to the undersurface 402-5 of bottom plate 402 by fasteners 499. Latching mechanism 450 is mounted between the front and rear plates 404, 406 and is used to slidably engage the media restraint 400 to the track 230 in front section 200. Front plate 404 may have a recess 412 (see FIGS. 11A-11B) for receiving latching mechanism 450. An opening 409 is provided in top plate 408 to access latching mechanism 450. Top plate 408 may be integrally molded as part of rear plate 406 or as part of front plate 404. Rear plate 406 is attached to front plate 404 by one or more fasteners 499.

Figure 12A:
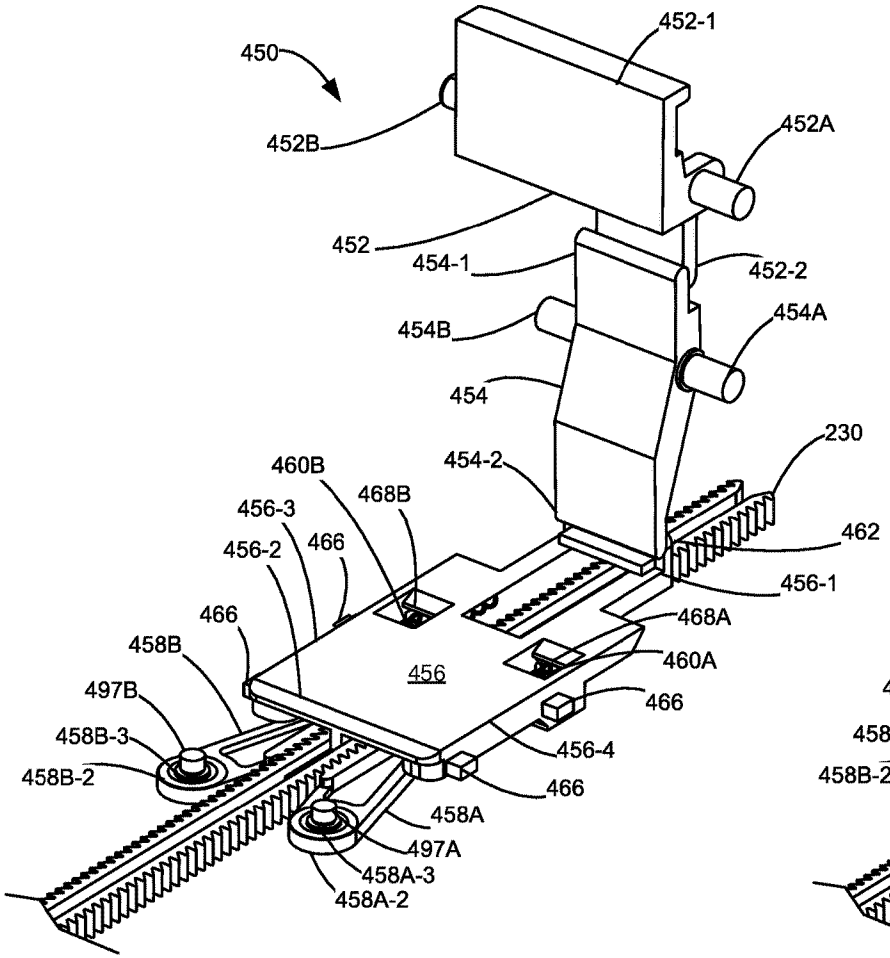
Figure 12A Prior Art

In FIGS. 11A-11B, rear and top plates 406, 408 have been removed to show example latching mechanism 450 positioned within a recess 412 provided in front plate 404 of media restraint 400. In FIGS. 11A-11B, example latching mechanism 450, as mounted, is shown in a first latched position and a second actuated or unlatched position, respectively. FIGS. 12A-12B show example latching mechanism 450 in the engaged or latched and the actuated or unlatched positions with respect to track 130. Example latching mechanism 450 is a known design and includes an actuator linkage 452, a transfer linkage 454, a sled plate 456, a first and a second latching cam plate 458A, 458B and a first and a second biasing member 460A, 460B, shown as coil springs 460A, 460B.

Referring to FIGS. 11A-12B, actuator link 452 has a top end 452-1 and a bottom end 452-2 and has opposed pivot arms 452A, 453B extending therefrom approximately midway between the top and bottom ends 452-1, 452-2. Transfer link 454 has a top end 454-1 and a bottom end 452-2 and has opposed pivot arms 454A, 454B extending therefrom approximately midway between the top and bottom ends 454-1, 454-2. Pivot arms 452A, 452B are received in respective cradles 416A, 416B provided on front plate 404 while pivot arms 454A, 454B are received in respective slots 418A, 418B provided on front plate 404 below respective cradles 416A, 416B. The bottom end 452-2 of actuator link 452 overlaps the top end 454-1 of transfer link 454 which is between bottom end 452-1 and front plate 406.

Sled plate 456 has a rear edge 456-1, a front edge 456-2, a left edge 456-3, a right edge 456-4 and an under surface 456-5. Sled plate 456 is positioned below and parallel to bottom plate 402. Depending from rear edge 456-1 is an upwardly extending lip 462 that abuts the bottom end 454-2 of transfer link 454 which is rearward of lip 462. A pair of mirror image curved camming channels 464A, 464B are provided on under surface 456-5 of sled plate 456. The rear ends 464A-1, 464B-1 of camming channels 464A, 464B are spaced apart but are closer to one another than front ends 464A-2, 464B-2 of camming channels 464A, 464B. Camming channels 464A, 464B diverge going from the rear to the front. Projections 466 outwardly extend from the left and right edges of sled plate 456. Projections 466 are slidably received into left and right L-rails 442A, 442B depending down from support plate 440 and parallel to the left and right edges 440-3, 440-4, thereof.

Latching camming plates 458A, 458B have respective front ends 458A-2, 458B-2 pivotally mounted to support plate 440. Openings 458A-3, 458B-3 in latching camming plates 458A, 458B and fasteners 497A, 497B are provided for this mounting. Rear ends 458A-1, 458B-1 of latching camming plates 458A, 458B, have upwardly depending cylindrical members 470A, 470B, that are slidably received into respective camming channels 464A, 464B and serve as cam followers. Serrated portions 466A, 466B are provided on the inner sides of camming plates 458A, 458B and engage with track 230 when media restraint 400 is in a first or latched position.

Biasing members 460A, 460B, shown as coil springs 460A, 460B, are mounted between seats 468A, 468B provided on sled plate 456 and respective seats 444A, 444B provided on support plate 440. Latching cam plates 458A, 458B, camming channels 464A, 464B, L-rails 442A, 442B, seats 444A, 444B, 468A, 468B, and biasing members 460A, 460B are in a mirrored configuration about track 230 when media restraint 400 is installed in removable media tray 100.

Operation of latching mechanism 450 will be briefly explained with reference to FIGS. 11A-12B. In FIGS. 11A, 12A, latching cam plates are engaged with track 230. Cam followers 470A, 470B are positioned within camming channels 464A, 464B at the rear ends 464A-1, 464B-1 thereof. When the pinching force indicated by force vector F1 in FIG. 12B is applied by a user to the top end 452-1 of actuator link 452, actuator link 452 pivots rearward as indicated by directional arrow A1 in FIG. 12B. This action causes the bottom 452-2 of actuator link to rotate transfer link 454 forward as indicated by directional arrow A2. In turn, the bottom end 454-1 of transfer link 454 translates sled plate 456 rearward as indicated by directional arrow A3, compressing biasing members 460A, 460B. This in turn translates camming channels 464A, 464B rearward. As camming channels 464A, 464B translate rearward, cam followers 470A, 470B slide in these channels and diverge until they reach the camming channel front ends 464A-2, 464B-2. As cam followers 470A, 470B diverge, latching cam plates 458A, 458B, pivot away from engagement with track 230 allowing media restraint 400 to be moved. Upon removal of the pinching forces, biasing members 460A, 460B translate sled plate 456 forward causing cam followers 470A, 470B to return to their position at the camming slot rear ends 464A-1, 464B-1. This in turn pivots latching cam plates 458A, 458B back into engagement with track 230 latching media restraint 400 to track 230. The function of latching mechanism 450 may be accomplished by a wide variety of mechanisms. Accordingly, latching mechanism 450 should not be considered as a limitation of the present disclosure.

Figure 13:
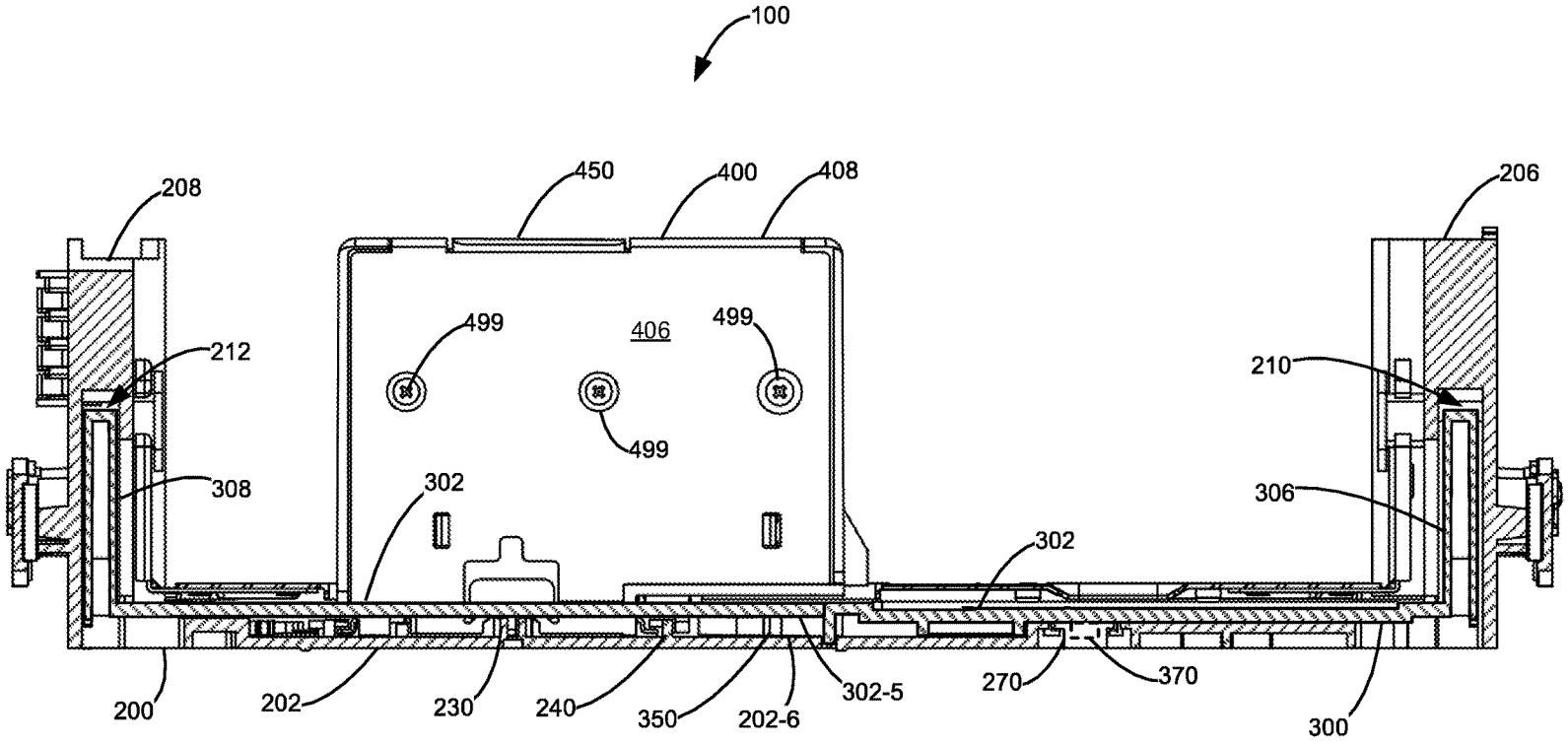
FIG. 13 is a rear sectional view of the removable media tray taken along line 13-13 of FIG. 2 showing the tray extension mounted to the front section.

Referring to FIG. 13, a further feature of the present removable media tray 100 is shown. When left and rights wing walls 306, 308 are present, left and right side walls 206, 208 may be provided with respective pockets 210, 212 that are sized to receive the wing walls 306, 308, respectively, when tray extension 300 is in its retracted position. Cam 350 is sandwiched between the undersurface 302-5 of the bottom 302 of tray extension 300 and the upper surface 202-6 of bottom 202 of front section 200. Media restraint 400 is shown engaged with tracks 230, 240. Hook 270 and catch 370 are also shown.

Figure 15A:
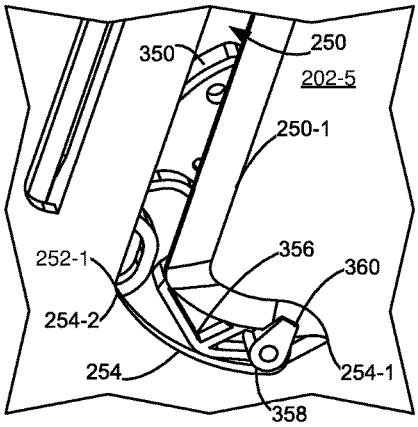
FIGS. 15A-15E are partial perspective views showing sequence of the transition of the locking arm of the cam of the tray extension within a J-slot of the front section of the removable media tray as the media restraint moves the tray extension from its retracted position to its fully extended position.
Figure 15B:
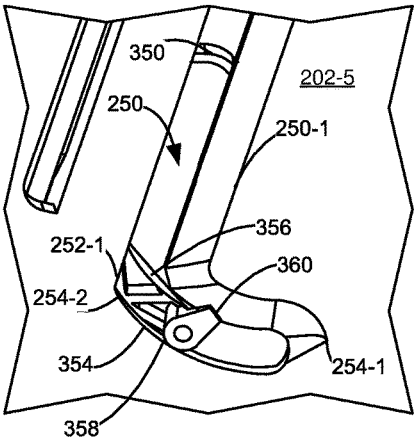
Figure 15C:
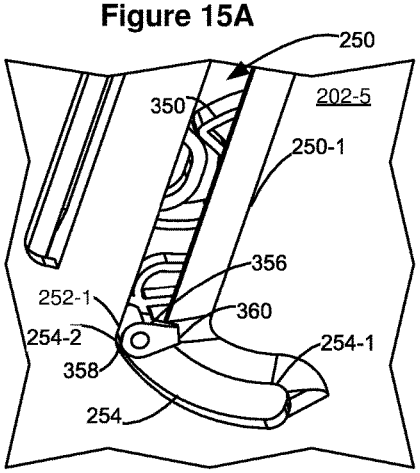
Figure 15D:
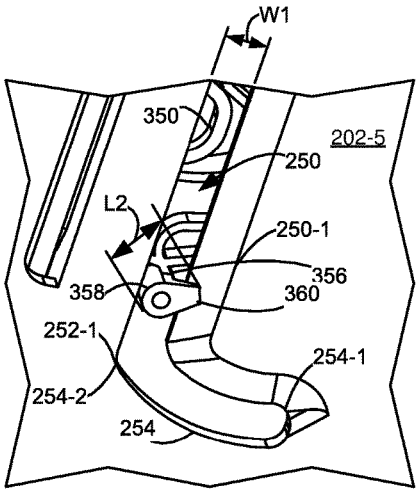
Figure 15E:
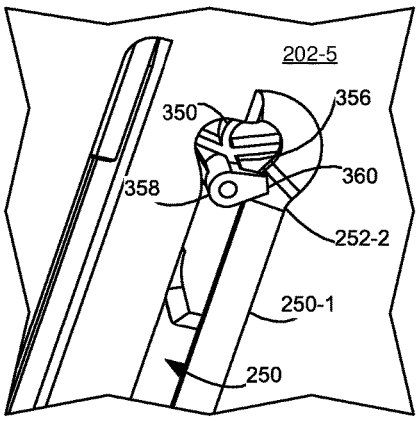

Operation of tray extension 300 may be viewed with references to FIGS. 14A-15E. FIGS. 14A-14D show the travel of media restraint 400 from its most forward position, the shortest designed-for media length, to its most rearward or most extended position at the maximum designed-for media length. In FIGS. 14A-14D, bottom 302 of tray extension 300 has been partially cut away to reveal the cam 350 hidden beneath it. FIGS. 15A, 15C and 15E correspond to FIGS. 14A, 14C, 14D showing the position of the locking arm 356 with J-slot 250 as media restraint 400 moves rearward while FIGS. 15B and 15D illustrate transitional movement of tray extension 300 and media restraint 400 between the positions shown in FIGS. 15A and 15C and FIGS. 15C and 15E, respectively. In FIG. 14A, six media length indicators labeled 260-1-260-6 are shown on bottom 202 of front section 200. Two additional media length indicators 260-7-260-8 on bottom 303 of tray extension 300 are seen when tray extension 300 is extended as shown in FIG. 14D. The media length indicators 260-1-206-8 are respectively for A6/A5 media, ST (statement) media, B5 media, EX (executive) media, LTR (letter) media, A4 media, FLO (folio) media and LGL (legal) media. The listed media sizes are examples only and should not be considered as a limitation of the present disclosure. Media restraint 400 may be placed along track 230 at positions other than those indicated by length indicators 260-1-260-8. Fewer or more media length indicators may be provided and are a matter of design choice.

In FIGS. 14A and 15A, media restraint 400 is at the position corresponding to the shortest designed-for media length, as shown for illustration only, as A6 media. Locking arm 356 is biased at the first end 254-1 of the curved section 254 of J-slot 250. The inner face 304-1 of rear wall 304 of tray extension 300 is substantially aligned with the rear edge 202-1 of bottom 202 of front section 200. In FIG. 14B, media restraint 400 has moved rearward along track 230 to media length indicator 206-5 and locking lobe 430 on bottom plate 402 of rear media restraint 400 is about to enter locking notch 354 of cam 350. While rear media restraint 400 has moved, tray extension 300, cam 350 and locking arm 356 have not. In FIGS. 14C and 15C, rear media restraint 400 has travelled further rearward to media length indicator 260-6 and has entered into recess 314 in rear wall 304. At this point, front plate 404 of media restraint 400 is substantially flush with the inner face 304-1 of rear wall 304 of tray extension 300. Also, at this point, locking lobe 430 has engaged with cam 350, entered locking notch 354, and rotated locking arm 356 away from the first end 254-1 to the second end 254-2 of curved section 254 where locking arm 356 is about to enter the first end 252-1 of straight section 252 of J-slot 250 freeing tray extension 300 from front section 200. The rotation of cam 350 caused by the movement of media restraint 400 from media length indicator 260-5 (LTR) to indicator 260-6 (A4) is illustrated in the sequence of FIGS. 15A-15C. From this point and for farther rearward moment, media restraint 400 and tray extension 300 are locked together and move together as tray extension is extended. As shown in FIG. 15D, locking arm 356 travels within the straight section 252 of J-slot 250 when tray extension 300 is being extended using rear media restraint 400.

Tray extension 300 has reached its maximum extension in FIGS. 14D and 15E. Bottom plate 402 is within cutout 312 and provides an additional surface for supporting the longer media lengths. Locking arm 356 has reached the second end 252-2 of the straight section 252 of J-slot 250 and hook 270 has engaged catch 370 as previously described. The media length indicator is at the longest designed-for media length, which is illustrated as a non-limiting example as being media length indicator 260-8 LGL that is shown aligned with the rear edge 202-1 of front section 200.

The previously described actions are reversed as tray extension 300 is retracted. Media restraint 400 and tray extension 300 move together until media restraint 400 transitions from the first end 252-1 of straight section 252 into the second end 254-2 of curved section 254 of J-slot 250. At this point locking lobe 430 on media restraint 400 is disengaging from locking notch 354 and cam 350 is rotating back to its initial position where locking arm 356 is at the first end 254-1 of curved section 254 of J-slot 250 once again locking tray extension 300 to front section 200. Once locking lobe 430 and locking notch 354 are disengaged, rear media restraint 400 may once again move independently of tray extension 300. In other words, rear media restraint 400 is able to be moved independently of tray extension 300 between the shortest designed-for media length position to the designed-for media length at which locking lobe 430 and locking notch 358 become fully engaged. With the media restraint 400 and tray extension 300 of the present disclosure, tray extension 300 will extend and retract by merely moving media restraint 400 along track 230. Further, tray extension 300 may be placed at any position between its fully retracted position and its fully extended position using media restraint 400.

When tray extension 300 is locked onto front section 200, rear wall 304 is aligned with media length indicator 260-6 (A4). For the illustrated removable media tray 100 when tray extension 300 is at the longest designed-for media length, e.g. legal media, tray extension 300 translates through a distance of about 70 mm. However by lengthening the straight section 252 of J-slot 250 and/or lengthening the bottom 202 of front section 200, tray extension 300 may be translated further rearward to accommodate longer media lengths such as ledger media or A3 media.

Front section 200 and tray extension 300 are locked together when locking arm is within the curved section 254 of J-slot 250. This occurs when the media restraint 400 is positioned between media length indicators 260-1(A6) and 260-6(A4) and media restraint 400 moves independently of tray extension 300. When media restraint 400 and tray extension 300 move rearward beyond media length indicator 260-6, tray extension 300 unlocks from front section 200 and media restraint 400 locks together with tray extension 300 via locking lobe 430 and cam 350. The media length at which tray extension 300 unlocks from front section 200 and media restraint 400 and tray extension 300 lock together is a matter of design choice.

The foregoing description of several methods and an embodiment of the present disclosure have been presented for purposes of illustration. It is not intended to be exhaustive or to limit the present disclosure to the precise steps and/or forms disclosed, and obviously many modifications and variations are possible in light of the above description. It is intended that the scope of the present disclosure be defined by the claims appended hereto.

What is claimed is:

1. A removable media tray for holding media to be fed to an imaging device, the removable media tray comprising:

a front section and a tray extension slidably received in the front section;

the front section including:

a bottom having a front edge, a rear edge, a left side edge and a right side edge; the bottom including:

a J-slot having a curved section and a straight section, the curved section having a first end and a second end and positioned away from the rear edge of the bottom of the front section at a first predetermined distance D1, the straight section being parallel to the left and right side edges of the bottom of the front section and extending toward the rear edge thereof, the straight section having a first end and a second end, the first end of the straight section in communication with the second end of the curved section and the second end of the straight section being a second predetermined distance D2 from the rear edge of the bottom of the front section; and, at least one guide slot parallel to the left and right side edges of the bottom of the front section;

a front wall positioned along the front edge of the bottom of the front section; and, a track parallel to the left and right side edges, the track having one end adjacent to the rear edge of the bottom of the front section and extending a third predetermined distance D3 from the rear edge of the bottom of the front section toward the front wall;

the tray extension including:

a bottom aligned with the bottom of the front section, the bottom of the tray extension having a front edge, a rear edge, a left edge, a right edge, and a cutout;

a rear wall positioned along the rear edge of the bottom of the tray extension and forming at least in part a rear end of the cutout;

at least one guide rail parallel to the left and right edge of the tray extension, the at least one guide rail slidably received in the at least one guide slot of the bottom of the front section; and, a spring-biased cam rotatably attached to an undersurface of the bottom of the tray extension, the cam having a locking notch and a radially extending locking arm slidably received and retained in the J-slot, the cam being biased to a first position where the cam and locking arm are turned toward and engaged with the curved section of the J-slot;

and, a user-actuated media restraint for restraining a rear edge of the media when present, the media restraint being slidably engageable with the track having a first state latched to the track, and, when actuated, a second state unlatched from the track allowing the media restraint to slide along the track, the media restraint including a bottom plate having a locking lobe extending from a side edge of the bottom plate, the locking lobe sized to be received in the locking notch of the cam, wherein, with the locking arm engaged with the curved section of the J-slot, the tray extension is locked to the front section, and, further wherein, with the media restraint in the second state, upon rearward sliding of the media restraint on the track from a position inboard of the curved section of the J-slot toward the rear edge of the front section, the media restraint moves independently of the tray extension, upon continued rearward sliding, the locking lobe encounters the locking notch and rotates the cam away from its first position moving the locking arm to a position to enter the first end of the straight section of the J-slot, upon still further rearward sliding, the locking lobe engages with the locking notch and the locking arm enters the straight portion of the J-slot locking the media restraint and tray extension together and unlocking the tray extension from the front section, and, upon continued rearward sliding, the media restraint enters the cutout in the bottom of the tray extension and the media restraint and the tray extension slide rearward together with the locking arm travelling within the straight section of the J-slot.

2. The removable media tray of claim 1 wherein, upon forward sliding of the media restraint on the track from a position outboard the curved portion of the J-slot toward the front wall, the media restraint and the tray extension move together, upon further forward sliding, the locking arm enters the second end of the curved section of the J-slot and the locking lobe releases from the locking notch, and, upon still further forward sliding, the cam rotates back to its first position and the locking arm enters the curved section of the J-slot and the media restraint releases from the tray extension and moves independently thereof.

3. The removable media tray of claim 1 wherein, D1 is in the range of about 96 mm to about 97 mm, D2 is in the range of about 38 mm to about 40 mm, and D3 is in the range of about 250 mm to about 252 mm.

4. The removable media tray of claim 1 wherein, the bottom plate of the media restraint has a restraint wall along a rear edge thereof and the rear wall of the tray extension has a recess sized to receive the restraint wall such that a front face of the restraint wall is substantially flush with an inner face of the rear wall when the media restraint and tray extension are locked together and the media restraint is at a predetermined position on the track.

5. The removable media tray of claim 1 wherein, the undersurface of the bottom of the tray extension has a keyed post depending therefrom, the cam has a keyed center opening corresponding to the keyed post with the keyed post received through the keyed center opening for rotatably mounting the cam to the tray extension, and a biasing spring has a first end engaged with a notch on the keyed post and a second end engaged with a recess in the cam, the biasing spring biasing the locking arm of the cam toward the curved section of the J-slot.

6. The removable media tray of claim 1 wherein, the locking arm has a hook at a distal end thereof that engages with a wall of the J-slot.

7. The removable media tray of claim 6 wherein, the second end of the straight section of the J-slot has an expanded portion to allow for insertion of the hook therethrough.

8. The removable media tray of claim 6 wherein, the wall of the J-slot has a bevel and the hook on the locking arm has a matching bevel.

9. The removable media tray of claim 1 wherein, a catch depends from the undersurface of the bottom of the tray extension and a flexible hook depends from a top surface of the bottom of the front section and is aligned with the catch, the catch engaging with the flexible hook to stop rearward motion of the tray extension and the media restraint when a position corresponding to a longest designed-for media length has been reached.

10. A removable media tray for holding media to be fed to an imaging device, the removable media tray comprising:

a front section and a tray extension slidably received in the front section;

the front section including:

a bottom having a front edge, a rear edge, a left side edge and a right side edge; the bottom including:

a J-slot having a curved section and a straight section, the curved section having a first end and a second end and positioned away from the rear edge of the bottom of the front section at a first predetermined distance D1, the straight section being parallel to the left and right side edges of the bottom of the front section and extending toward the rear edge thereof, the straight section having a first end and a second end, the first end of the straight section in communication with the second end of the curved section and the second end of the straight section being a second predetermined distance D2 from the rear edge of the bottom of the front section; and, a guide slot parallel to the left and right side edges of the bottom of the front section, the guide slot having an open end facing toward the rear edge of the bottom of the front section and a closed end positioned at a third predetermined distance D3 from the rear edge of the bottom of the front section;

a front wall positioned along the front edge of the bottom; and, a serrated track parallel to the left and right side edges, the track having one end at the rear edge of the bottom of the front section and extending a fourth predetermined distance D4 from the rear edge toward the front wall;

the tray extension including:

a bottom aligned with the bottom of the front section, the bottom of the tray extension having a front edge, a rear edge, a left edge, a right edge, and a cutout;

a rear wall positioned along the rear edge of the bottom of the tray extension and forming at least in part a rear end of the cutout;

a planar guide projecting from the front edge of the bottom of the tray extension, a front edge of the guide being a fifth predetermined distance D5 from a front surface of the rear wall, the guide sized to be slidably received in the guide slot of the bottom of the front section; and a planar spring-biased cam rotatably attached to a bottom surface of the bottom of the tray extension, the cam having a locking notch and a radially-extending locking arm slidably received and retained in the J-slot, the cam being biased to a first position where the cam is turned toward and engaged with the curved section of the J-slot;

and, a media restraint being slidably engageable with the track, the media restraint including:

a bottom plate having:

a locking lobe extending from a side edge of the bottom plate, the locking lobe sized to be received in the locking notch of the cam; and, a channel in a bottom surface of the bottom plate for receiving the track;

a restraint wall depending upwardly along a rear edge of the bottom plate for restraining a rear edge of the media when present; and, a latching mechanism including:

a latch biased into engagement with the track; and, a user-activated actuator mechanism coupled to the latch for releasing the latch from engagement with the track allowing the media restraint to be moved along the track, wherein, with the locking arm engaged with the curved section of the J-slot, the tray extension is locked to the front section and the media restraint is independently moveable along the track between a position corresponding to a shortest designed-for media length and the rear wall of the tray extension, and, further wherein, with the latch released from the track, upon rearward sliding of the media restraint on the track from a position inboard of the curved section of the J-slot toward the rear edge of the front section, the media restraint moves independently of the tray extension, upon continued rearward sliding, the locking lobe encounters the locking notch and rotates the cam away from its first position in the curved section of the J-track moving the locking arm in the curved section of the J-slot to a position to enter the first end of the straight section of the J-slot, upon still further rearward sliding, the locking lobe engages the locking notch and the locking arm enters the straight portion of the J-slot locking the media restraint and tray extension together and unlocking the tray extension from the front section, and, upon yet continued rearward sliding, the media restraint enters the cutoff in the bottom of the tray extension and the media restraint and the tray extension slide rearward together with the locking arm travelling within the straight section of the J-slot until the locking arm reaches the second end of the straight section of the J-slot.

11. The removable media tray of claim 10 wherein, upon forward sliding of the media restraint on the track from a position outboard the curved portion of the J-slot toward the front wall, the media restraint and the tray extension move together, upon further forward sliding, the locking arm enters the second end of the curved section of the J-slot and the locking lobe releases from the engagement notch, and upon still further forward sliding the cam rotates back to its first position and the locking arm enters the curved section of the J-slot locking the tray extension to the front section and the media restraint releases from the tray extension and moves independently thereof.

12. The removable media tray of claim 10 wherein, D1 is in the range of about 96 mm to about 97 mm, D2 is in the range of about 38 mm to about 40 mm, and D3 is in the range of about 250 mm to about 252 mm, D4 is in the range of about 188 mm to about 190 mm, and D5 is in the range of about 187 mm to about 189 mm.

13. The removable media tray of claim 10 wherein, the bottom plate of the media restraint has a restraint wall along a rear edge thereof and the rear wall of the tray extension has a recess sized to receive the restraint wall such that a front face of the restraint wall is substantially flush with an inner face of the rear wall when the media restraint and tray extension are locked together.

14. The removable media tray of claim 10 wherein, the locking arm is engaged with the J-slot by a locking pin depending from a free end of the locking arm, the locking pin having a radial extension member on a free end of the locking pin, a length of the radial extension member being greater than a width of the J-slot.

15. The removable media tray of claim 14 wherein, the second end of the straight section has an expanded portion to allow for insertion of the locking pin and the radial extension member into and through the J-slot.

16. The removable media tray of claim 10 wherein, an undersurface of the bottom of the tray extension has a keyed post depending therefrom, the cam has a keyed center opening corresponding to the keyed post with the keyed post received through the keyed center opening for rotatably mounting the cam to the tray extension, and a biasing spring has a first end engaged with a notch on the keyed post and a second end engaged with a recess in the cam, the biasing spring biasing the locking arm of the cam toward the curved section of the J-slot.

17. The removable media tray of claim 10 wherein, a catch depends from an undersurface of the bottom of the tray extension and a flexible hook depends from a top surface of the bottom of the front section and is aligned with the catch, the catch engaging with the flexible hook to stop rearward motion of the tray extension and media restraint when a position corresponding to a longest designed-for media length has been reached.

18. A removable media tray for holding media to be fed to an imaging device, the removable media tray comprising:

a front section and a tray extension slidably received in the front section;

the front section including:

a bottom having a front edge, a rear edge, a left side edge and a right side edge, the bottom including:

a J-slot having a curved section and a straight section, the curved section having a first end and a second end and positioned away from the rear edge of the bottom of the front section at a first predetermined distance D1, the straight section being parallel to the left and right side edges of the bottom of the front section and extending toward the rear edge thereof, the straight section having a first end and a second end, the first end of the straight section in communication with the second end of the curved section and the second end of the straight section being a second predetermined distance D2 from the rear edge of the bottom of the front section; and, a guide slot parallel to the left and right side edges of the bottom of the front section, the guide slot having an open end at the rear edge of the bottom of the front section and a closed end positioned at a third predetermined distance D3 from the rear edge of the bottom of the front section;

a front wall, a left side wall, a right side wall positioned along the front, left and right edges, respectively, of the bottom of the front section, the front, left side, right side walls and bottom of the front section defining a media storage area having a length L1, the ends of the left and right side walls adjacent the rear edge of the bottom of the front section having a left and a right pocket, respectively, therein;

and, a serrated track parallel to the left and right side edges, the track having one end at the rear edge of the bottom and extending a fourth predetermined distance D4 from the rear edge and extending toward the front wall;

the tray extension including:

a bottom aligned with the bottom of the front section, the bottom of the tray extension having a front edge, a rear edge, a left edge and a right edge, the bottom of the tray extension having a cutout;

a rear wall positioned along the rear edge of the bottom of the tray extension and forming at least in part a rear end of the cutout, the rear wall having a recess therein;

a left wing wall and a right wing wall positioned along the left and right edges of the bottom of the tray extension, the right wing wall forming a right edge of the cutout; the left and right wing walls sized to be slidably received into the left and right pockets, respectively of the left side and right side walls;

a planar guide projecting from the front edge of the bottom of the tray extension and inset from the left and right edges, a left edge of the guide being adjacent to a right edge of the cutout in the bottom of the tray extension, a front edge of the guide being a fifth predetermined distance D5 from a front surface of the rear wall, the guide sized to be slidably received in the guide slot of the bottom of the front section; and, a planar spring-biased cam rotatably attached to a bottom surface of the bottom of the tray extension at a position adjacent to the right edge of the cutout in the bottom of the tray extension, the cam having a locking notch and a radially extending locking arm slidably received and retained in the J-slot, the cam being biased to a first position where the cam is turned toward and engaged with the curved section of the J-slot;

and, a media restraint being slidably engageable with the track, the media restraint including:

a bottom plate having:

a locking lobe extending from a side edge of the bottom plate, the locking lobe sized to be receive in the locking notch of the cam;

a channel in a bottom surface of the bottom plate for receiving the track; and, a restraint wall depending upwardly along a rear edge of the bottom plate for restraining a rear edge of the media when present;

and, a latching mechanism including:

a latch biased into engagement with the track; and, a user-activated actuator mechanism coupled to the latch for releasing the latch from engagement with the track allowing the media restraint to be moved along the track, wherein, with the locking arm engaged with the curved section of the J-slot, the tray extension is locked to the front section and the media restraint is independently movable between a position on the track corresponding to a shortest designed-for media length and the rear wall of the tray extension, and, further wherein, with the latch released from the track, upon rearward sliding of the media restraint on the track from a position inboard of the curved section of the J-slot toward the rear edge of the front section, the media restraint moves independently of the tray extension, upon continued rearward sliding, the locking lobe encounters the locking notch and rotates the cam away from its first position moving the locking arm to a position to enter the first end of the straight section of the J-slot, upon further rearward sliding, the locking lobe engages the locking notch and the locking arm enters the straight portion of the J-slot locking the media restraint and tray extension together and unlocking the tray extension from the front section with the restraint wall being received into the recess of the rear wall, and, upon continued rearward sliding, the media restraint enters the cutoff in the bottom of the tray extension and the media restraint and the tray extension slide rearward together with the locking arm travelling within the straight section of the J-slot until the locking arm reaches the second end of the straight section of the J-slot.

19. The removable media tray of claim 18 wherein, upon forward sliding of the media restraint on the track from a position outboard the curved portion of the J-slot toward the front wall, the media restraint and the tray extension move together, upon further forward sliding, the locking arm enters the second end of the curved section of the J-slot and the actuation lobe releases from the engagement notch, and, upon still further forward sliding, the cam rotates back to its first position and the lock arm enters the curved section of the J-slot locking the tray extension to the front section and the media restraint releases from the tray extension and moves independently thereof with the restraint wall exiting the recess in the rear wall.

20. The removable media tray of claim 18 wherein, L1 is in the range of 279 mm to 297 mm when the tray extension is moved between a fully retracted position adjacent to the rear edge of the bottom of the front section to its fully extended position at the longest designed-for media length.

21. The removable media tray of claim 18 wherein, D1 is in the range of about 96 mm to about 97 mm, D2 is in the range of about 38 mm to about 40 mm, and D3 is in the range of about 250 mm to about 252 mm, D4 is in the range of about 188 mm to about 190 mm, and D5 is in the range of about 187 mm to about 189 mm.

22. The removable media tray of claim 18 wherein, the locking lobe and the locking notch have substantially similar shapes.

23. The removable media tray of claim 18 wherein, a centerline of the locking notch is in the ranges of about 32 degrees to about 34.5 degrees away from a centerline of the locking arm.

24. The removable media tray of claim 18 wherein, the locking arm is engaged with the J-slot by a locking pin depending from a free end of the locking arm, the locking pin having a radial extension member on a free end of the locking pin, a length of the radial extension being greater than a width of the J-slot.

25. The removable media tray of claim 24 wherein, the second end of the straight section has an expanded portion to allow for insertion of the locking pin and the radial extension member into and through the J-slot.

26. The removable media tray of claim 18 wherein, an undersurface of the bottom of the tray extension has a keyed post depending therefrom, the cam has a keyed center opening corresponding to the keyed post with the keyed post received through the keyed center opening for rotatably mounting the cam to the tray extension, and a biasing spring has a first end engaged with a notch on the keyed post and a second end engaged with a recess in the cam, the biasing spring biasing the locking arm of the cam toward the curved section of the J-slot.

27. The removable media tray of claim 18 wherein, a catch depends from an undersurface of the bottom of the tray extension and a flexible hook depends from a top surface of the bottom of the front section and is aligned with the catch, the catch engaging with the flexible hook to stop rearward motion of the tray extension and media restraint when a position corresponding to a longest designed-for media length has been reached.

* * * * *